US008422907B2

(12) United States Patent
Fujiki et al.

(10) Patent No.: US 8,422,907 B2
(45) Date of Patent: Apr. 16, 2013

(54) IMAGE FORMING APPARATUS, CONTROL DEVICE, DETECTING METHOD OF REFERENCE INDEX ON TRANSFER BODY, AND COMPUTER READABLE MEDIUM

(75) Inventors: Ryuji Fujiki, Yokohama (JP); Yasuhiro Arai, Yokohama (JP); Kenji Koizumi, Yokohama (JP); Hayato Yoshikawa, Yokohama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 361 days.

(21) Appl. No.: 12/952,749

(22) Filed: Nov. 23, 2010

(65) Prior Publication Data

US 2011/0305478 A1 Dec. 15, 2011

(30) Foreign Application Priority Data

Jun. 10, 2010 (JP) ..... 2010-132732

(51) Int. Cl.
*G03G 15/16* (2006.01)

(52) U.S. Cl.
USPC ..... 399/101; 399/301

(58) Field of Classification Search ..... 399/34, 399/43, 49, 101, 301
See application file for complete search history.

(56) References Cited

FOREIGN PATENT DOCUMENTS

| | | | |
|---|---|---|---|
| JP | 2000-066562 | A | 3/2000 |
| JP | 2004-264379 | A | 9/2004 |
| JP | 2009-128440 | A | 6/2009 |

*Primary Examiner* — Walter L Lindsay, Jr.
*Assistant Examiner* — Barnabas Fekete
(74) *Attorney, Agent, or Firm* — Sughrue Mion, PLLC

(57) ABSTRACT

An image forming apparatus includes: a latent image forming unit forming a latent image; a transfer body on which a reference index for setting an output start time point of image data is formed; a detecting unit outputting a detection signal changing according to passing of an adhesion material on the transfer body; a controller that starts a first period during which change of the detection signal is ignored, according to first change of the detection signal, starts a second period after the first period, regards second change of the detection signal occurring first in the second period as a reference of the output start time point, and ignores change of the detection signal after the second change, to control outputting the image data; and a cleaning information outputting unit outputting information on cleaning the transfer body according to the number of changes of the detection signal in these periods.

9 Claims, 15 Drawing Sheets

IMAGE FORMING APPARATUS, CONTROL DEVICE, DETECTING METHOD OF REFERENCE INDEX ON TRANSFER BODY, AND COMPUTER READABLE MEDIUM

CROSS REFERENCE TO RELATED APPLICATIONS

This application is based on and claims priority under 35 USC §119 from Japanese Patent Application No. 2010-132732 filed Jun. 10, 2010.

BACKGROUND

1. Technical Field

The present invention relates to an image forming apparatus, a control device, a detecting method of a reference index on a transfer body, and a computer readable medium storing a program.

2. Related Art

As an image forming apparatus, such as a copier and a printer, using an electrophotographic method, there is known a color image forming apparatus that sequentially superimposes color toner images on an endless intermediate transfer belt or an endless sheet transport belt, thereby to form a color image.

SUMMARY

According to an aspect of the present invention, there is provided an image forming apparatus including: a latent image forming unit that emits light in accordance with image data on receiving input of the image data, and that scans and exposes an image carrier with the light, to form a latent image on the image carrier; a transfer body on which a toner image is transferred and a reference index is formed, the toner image being formed by developing the latent image on the image carrier, the reference index serving as a reference for setting an output start time point from which the image data is outputted to the latent image forming unit; a detecting unit that is arranged so as to face the reference index formed on the transfer body, and that outputs a detection signal changing in accordance with passing of an adhesion material on the transfer body including the reference index; a controller that acquires the detection signal outputted from the detecting unit, starts a first period during which a change of the detection signal is ignored, according to a first change occurring in the detection signal, starts a second period after the first period elapses, regards a second change of the detection signal occurring for the first time in the second period as the reference of the output start time point of the image data to the latent image forming unit, and ignores a change of the detection signal after the second change occurs in the second period, thereby to control output of the image data; and a cleaning information outputting unit that acquires the detection signal outputted from the detecting unit, measures any one of change duration time of the detection signal caused by passing of the reference index and the number of changes of the detection signal in at least any one of the first period and the second period set by the controller, and outputs information on cleaning of the transfer body in accordance with any one of the change duration time and the number of changes having been measured.

BRIEF DESCRIPTION OF THE DRAWINGS

Exemplary embodiment(s) of the present invention will be described in detail based on the following figures, wherein:

FIG. 7-1 is a flowchart showing a procedure of processing when the belt reference signal generating unit of the reference signal generator generates the belt reference signal;

FIG. 7-2 is a flowchart showing a procedure of processing when the belt reference signal generating unit of the reference signal generator generates the belt reference signal;

FIG. 8-1 is a flowchart showing a procedure of processing when the cleaning instruction unit of the reference signal generator outputs the instruction signal to give an instruction to perform the operation to remove adhesion materials from the intermediate transfer belt;

FIG. 8-2 is a flowchart showing a procedure of processing when the cleaning instruction unit of the reference signal generator outputs the instruction signal to give an instruction to perform the operation to remove adhesion materials from the intermediate transfer belt;

DETAILED DESCRIPTION

An exemplary embodiment of the present invention will be described below in detail with reference to the accompanying drawings.

<Description of Image Forming Apparatus>

Figure 1:
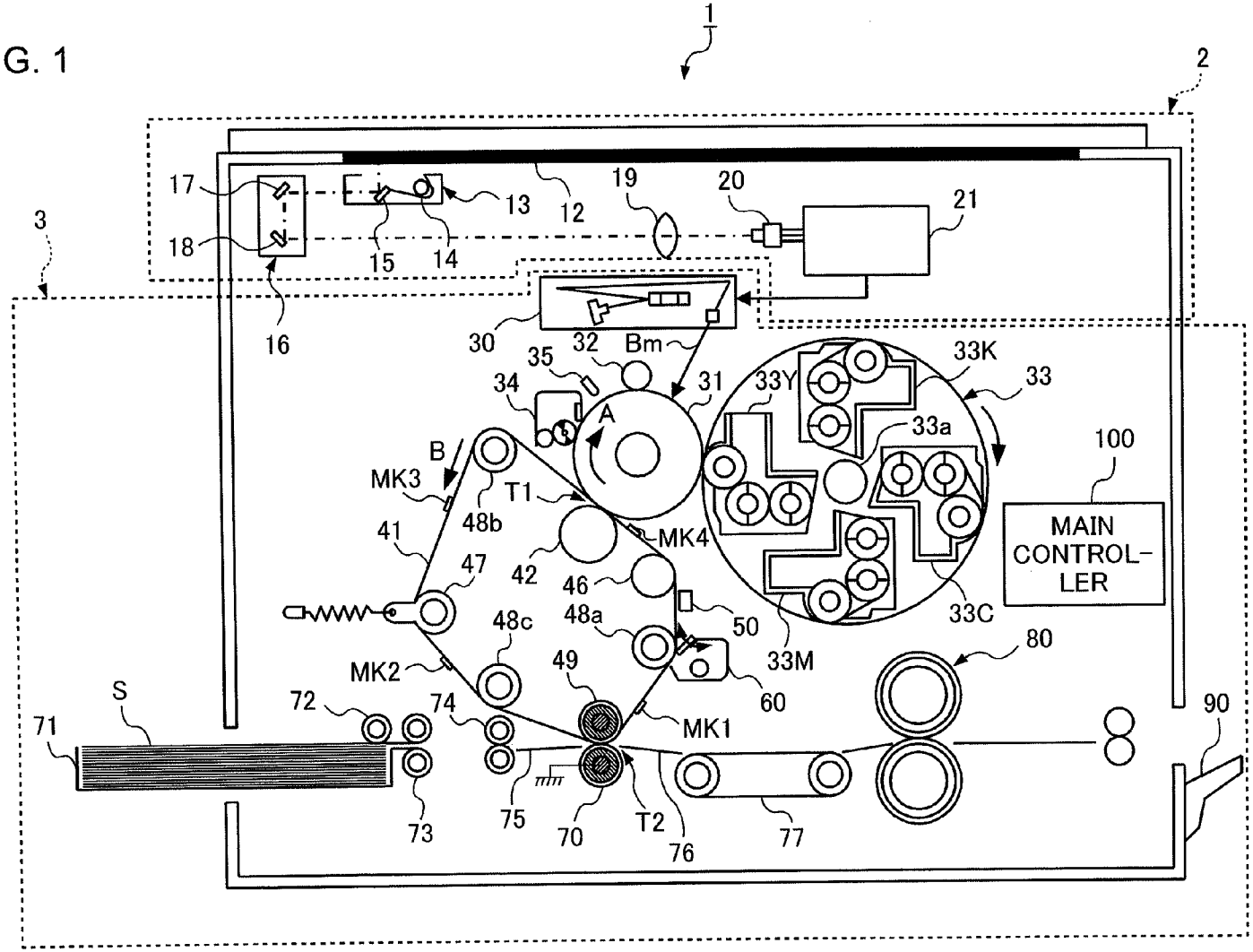
FIG. 1 is a diagram showing an image forming apparatus to which the exemplary embodiment is applied.

FIG. 1 is a diagram showing an image forming apparatus 1 to which the present exemplary embodiment is applied. The image forming apparatus 1 shown in FIG. 1 includes an image reading part 2 and an image forming part 3.

<Description of Image Reading Part>

The image reading part 2 includes: a transparent platen glass 12 on which a document (not shown) to be copied is put;

a document lighting unit 13 that is movable in the lateral direction in FIG. 1 and is configured by a light source 14 illuminating the document and a first reflection mirror 15 reflecting light having been reflected by the document; and a mirror unit 16 that includes a second reflection mirror 17 and a third reflection mirror 18 reflecting light from the document lighting unit 13. Furthermore, the image reading part 2 includes: an image-forming lens 19 that is arranged on an optical path of the reflected light from the mirror unit 16; and a light receiving portion 20 that is formed of a charge coupled device (CCD) receiving the reflected light with which an image is formed by the image-forming lens 19.

The document lighting unit 13 irradiates the document with light from below the platen glass 12 while moving in the lateral direction in FIG. 1, and guides the reflected light from the document to the mirror unit 16. The mirror unit 16 guides the reflected light from the document lighting unit 13 to the image-forming lens 19, and the image-forming lens 19 then forms an image with the reflected light from the document on the light receiving portion 20. The light receiving portion 20 reads the reflected light from the document as analog signals (read image signals) of red (R), green (G) and blue (B), and sends the read image signals having been read to an image processor 21.

The image processor 21 converts the read image signals received from the light receiving portion 20 into digital data (AD conversion). Additionally, the image processor 21 performs various types of data processing, such as color conversion to yellow (Y), magenta (M), cyan (C) and black (K), density correction and scaling correction, and outputs the processed data to an optical scanning device 30 as image data for writing (digital data).

<Description of Image Forming Part>

The image forming part 3 includes: a photoconductive drum 31 as an example of an image carrier that rotates in the direction of an arrow A; a charging device 32 that charges the photoconductive drum 31; the optical scanning device 30 that irradiates the photoconductive drum 31 with a laser beam Bm modulated by a laser drive signal; a rotary developing device 33 in which four developing devices 33Y, 33M, 33C and 33K respectively containing color toners of Y, M, C and K are installed. The rotary developing device 33 rotates around a rotation shaft 33*a*, and sets each of the developing devices 33Y, 33M, 33C and 33K to a position facing the photoconductive drum 31. Furthermore, the image forming part 3 includes: a drum cleaner 34 that removes residual toner on the photoconductive drum 31; and a discharge lamp 35 that discharges electricity of the photoconductive drum 31 before charging by the charging device 32.

Additionally, the image forming part 3 includes a main controller 100 as an example of a controller (a control device) that controls overall operations of the image forming apparatus 1.

Furthermore, the image forming part 3 includes an intermediate transfer belt 41 as an example of a transfer body that is formed of a film-like endless belt and is arranged so as to be in contact with the surface of the photoconductive drum 31. The intermediate transfer belt 41 is provided with tension by a drive roll 46 rotating the intermediate transfer belt 41, a tension roll 47 stabilizing tension of the intermediate transfer belt 41, idler rolls 48*a* to 48*c* driven to rotate, and a back-up roll 49 for secondary transfer to be described later, and rotates in the direction of an arrow B. Additionally, a primary transfer roll 42 is arranged on the rear surface side of the intermediate transfer belt 41, at a primary transfer portion T1 where the intermediate transfer belt 41 is in contact with the photoconductive drum 31. The primary transfer roll 42 is arranged so as to be in pressure contact with the photoconductive drum 31 with the intermediate transfer belt 41 interposed therebetween. To the primary transfer roll 42, a voltage (a primary transfer bias) having a polarity opposite to the charging polarity of the toner (for example, a minus polarity) is applied. Thereby, the intermediate transfer belt 41 electrostatically attracts the toner images formed on the photoconductive drum 31, onto the intermediate transfer belt 41 in sequence, and forms superimposed toner images on the intermediate transfer belt 41.

Additionally, at a secondary transfer portion T2 where the intermediate transfer belt 41 faces a transportation route of a sheet S, a secondary transfer roll 70 is arranged on a toner held surface side (outside) of the intermediate transfer belt 41 so as to be contactable with and separable from the intermediate transfer belt 41, and the back-up roll 49 is arranged on the rear surface side (inside) of the intermediate transfer belt 41 to form a counter electrode to the secondary transfer roll 70.

When color toner images are formed, the secondary transfer roll 70 is set at a position separated from the intermediate transfer belt 41 until toner images except for the last color (color toner images of Y, M and C) pass an opposing portion to the secondary transfer roll 70. After that, the secondary transfer roll 70 is set at a position in contact with the intermediate transfer belt 41 in accordance with timing at which toner images including the last color (color toner images obtained by superimposing K on Y, M and C) are primarily transferred and transported to the secondary transfer portion T2. Then, the secondary transfer roll 70 is brought into pressure contact with the back-up roll 49 with the intermediate transfer belt 41 interposed therebetween, and a secondary transfer bias is formed between the secondary transfer roll 70 and the back-up roll 49. Thereby, the toner images are secondarily transferred onto the sheet S being transported to the secondary transfer portion T2.

In addition, on the downstream side of the secondary transfer portion T2 in the intermediate transfer belt 41, a belt cleaner 60 is arranged at a position facing the idler roll 48*a* with the intermediate transfer belt 41 interposed therebetween. The belt cleaner 60 is configured so as to be contactable with and separable from the intermediate transfer belt 41. When color toner images are formed, the belt cleaner 60 is retracted to a position separated from the intermediate transfer belt 41 until toner images except for the last color (color toner images of Y, M and C) pass an opposing portion to the belt cleaner 60. Then, the belt cleaner 60 is set at a position in contact with the intermediate transfer belt 41 at a time point after the color toner images of Y, M and C pass the opposing portion to the belt cleaner 60. Thereby, the belt cleaner 60 removes transfer residual toner after the toner images including the last color (color toner images obtained by superimposing K on Y, M and C) are secondarily transferred.

Additionally, on the surface of the intermediate transfer belt 41, stickers for position detection MK1 to MK4 as an example of a reference index that serves as a reference for positioning color toner images of Y, M, C and K on the intermediate transfer belt 41 (that is, a reference for an output start time point when the image data for writing is outputted to the optical scanning device 30) are arranged at plural positions (here, four positions). Furthermore, at a position on the downstream side of the belt cleaner 60, a sticker detection unit 50 as an example of a detecting unit that outputs a sticker detection signal for detecting passing of the stickers for position detection MK1 to MK4 is arranged. In this image forming apparatus 1, timing to write latent images corresponding to colors of Y, M, C and K onto the photoconductive drum 31 is controlled by using the sticker detection signal outputted by the sticker detection unit 50.

<Description of Stickers for Position Detection>

Figure 2:
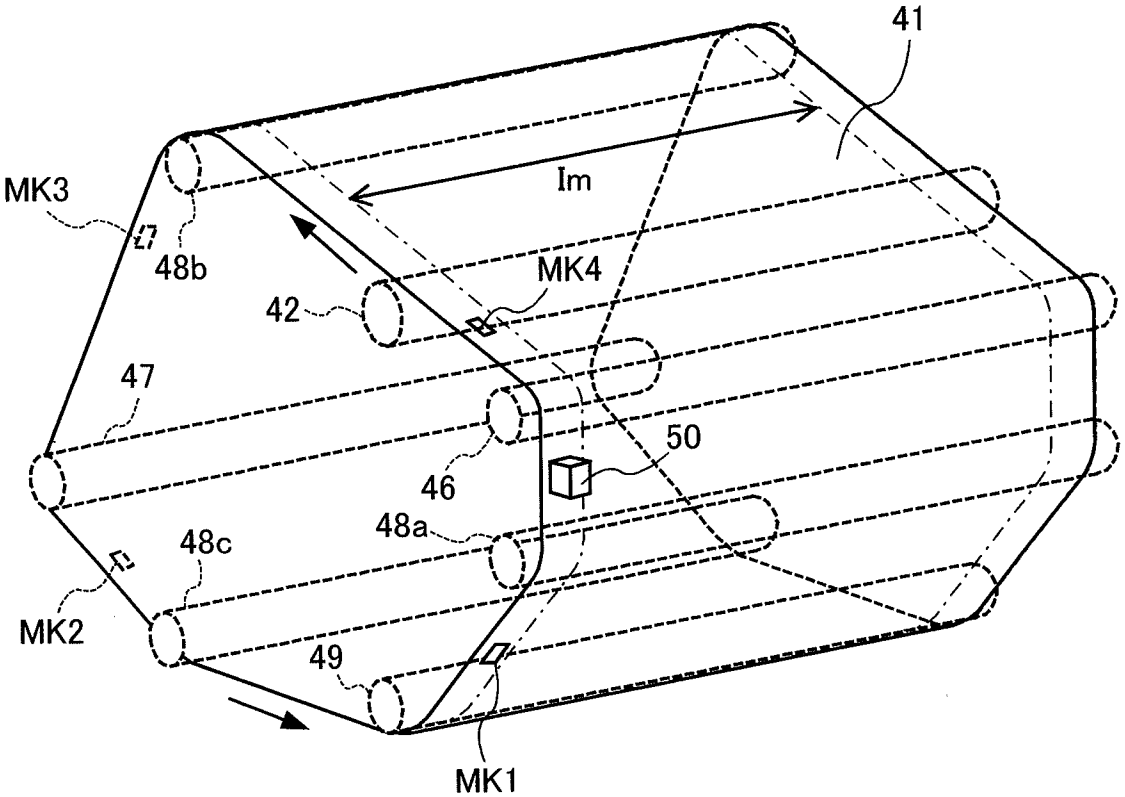
FIG. 2 is a diagram illustrating arrangement positions of the stickers for position detection on the surface of the intermediate transfer belt.

FIG. 2 is a diagram illustrating arrangement positions of the stickers for position detection MK1 to MK4 on the surface of the intermediate transfer belt 41. As shown in FIG. 2, the stickers for position detection MK1 to MK4 are arranged at four positions having substantially equal intervals therebetween in a proceeding direction (a circumferential direction indicated by an arrow in FIG. 2) of the intermediate transfer belt 41. As for the direction (width direction) orthogonal to the proceeding direction of the intermediate transfer belt 41, the stickers for position detection MK1 to MK4 are arranged in an outer region of a region (hereinafter, referred to as a "transfer region Im") where an image is transferred on the intermediate transfer belt 41. Corresponding to this, the sticker detection unit 50 is arranged in a region facing the stickers for position detection MK1 to MK4 placed in the outer region of the transfer region Im.

The stickers for position detection MK1 to MK4 according to the present exemplary embodiment are formed of a material having different light reflectivity from that of the surface of the intermediate transfer belt 41. Thus, the sticker detection unit 50 outputs the sticker detection signal changing in accordance with the difference in light reflectivity between the surface of the intermediate transfer belt 41 and the stickers for position detection MK1 to MK4. Alternatively, the stickers for position detection MK1 to MK4 may be formed of a material having different light transmittance from that of the surface of the intermediate transfer belt 41, and the sticker detection unit 50 may output the sticker detection signal changing in accordance with the difference in light transmittance.

Additionally, as a sheet transportation system, the image forming part 3 includes: a sheet container 71 in which the sheet S is placed; a pick-up roll 72 that picks up the sheet S stacked in the sheet container 71; transport rolls 73 that transport the sheet S having been picked up by the pick-up roll 72; registration rolls 74 that adjust transportation timing of the sheet S to the secondary transfer portion T2; a transport member 75 that guides the sheet S to the secondary transfer portion T2; and a guide 76 and a sheet transport belt 77 that guide the sheet S after the secondary transfer. On the downstream side of the sheet transport belt 77 in the sheet transport direction, the image forming part 3 also includes a fixing device 80 that is configured by a fixing roll and a pressurizing roll, and that fixes a toner image having been transferred onto the sheet S, by applying heat and pressure thereto. Furthermore, on the downstream side of the fixing device 80 in the sheet transport direction, the image forming part 3 includes a discharged sheet container 90 that accumulates the sheet S discharged outside.

<Description of Image Forming Operation in Image Forming Apparatus>

Next, a description will be given of an image forming operation in a case where copy processing is performed, as an example of image forming operations performed by the image forming apparatus 1 according to the present exemplary embodiment.

When a copy start key (not shown) of the image forming apparatus 1 is turned on by a user, the document put on the platen glass 12 is first illuminated by the light source 14 of the document lighting unit 13. The reflected light from the document is reflected by the first reflection mirror 15 of the document lighting unit 13 and the second reflection mirror 17 and the third reflection mirror 18 of the mirror unit 16. With the reflected light, an image is formed on the light receiving portion 20 by the image-forming lens 19. The light receiving portion 20 reads the reflected light from the document as analog signals (read image signals) of R, G and B. The read image signals having been read by the light receiving portion 20 are converted into image data for writing (digital data) of Y, M, C and K by the image processor 21, and are send to the optical scanning device 30. In the optical scanning device 30, a laser drive device (a laser driver: not shown) generates a laser drive signal in accordance with the image data for writing having been sent from the image processor 21, and drives a laser light source (not shown). Thereby, the photoconductive drum 31 is scanned and exposed with the laser beam Bm from the optical scanning device 30, the laser beam Bm being turned on and off in accordance with the image data for writing.

The photoconductive drum 31 is driven to rotate in the direction of the arrow A, and the surface thereof is charged at a predetermined minus potential by the charging device 32. In this state, the photoconductive drum 31 is scanned and exposed with the laser beam Bm from the optical scanning device 30 as an example of a latent image forming unit, the laser beam Bm being turned on and off in accordance with the image data for writing, and thereby, an electrostatic latent image is written onto the photoconductive drum 31. In this event, if the electrostatic latent image written on the photoconductive drum 31 is one corresponding to image information of yellow (Y), the rotary developing device 33 sets the developing device 33Y containing the Y toner at the position facing the photoconductive drum 31. Thereby, this electrostatic latent image is developed with the Y toner by the developing device 33Y, and a Y toner image is formed on the photoconductive drum 31. Then, the Y toner image formed on the photoconductive drum 31 is transferred onto the intermediate transfer belt 41 by the primary transfer bias applied to the primary transfer roll 42 at the primary transfer portion T1 where the photoconductive drum 31 and the intermediate transfer belt 41 face with each other. Meanwhile, residual toner on the photoconductive drum 31 after the primary transfer (transfer residual toner) is removed by the drum cleaner 34.

When a color image formed of toner images of plural colors is formed in the image forming apparatus 1, formation of color toner images on the photoconductive drum 31 and the primary transfer of the color toner images onto the intermediate transfer belt 41 are repeated by the number of colors. For example, when a full color image on which toner images of four colors are superimposed is formed, color toner images of Y, M, C and K are sequentially formed on the photoconductive drum 31, and the toner images are primarily transferred onto the intermediate transfer belt 41 in sequence. Thereby, every time the photoconductive drum 31 makes a rotation, the color toner images of Y, M, C and K are superimposed on the intermediate transfer belt 41.

In this case, the secondary transfer roll 70 is set at the position separated from the intermediate transfer belt 41 until toner images except for the last color (color toner images of Y, M and C) pass the opposing portion to the secondary transfer roll 70. After that, the secondary transfer roll 70 is set at the position in contact with the intermediate transfer belt 41 in accordance with timing at which toner images including the last color (color toner images obtained by superimposing K on Y, M and C) are primarily transferred and transported to the secondary transfer portion T2. Meanwhile, the belt cleaner 60 is set at the position in contact with the intermediate transfer belt 41 at a time point after the color toner images of Y, M and C pass the opposing portion to the belt cleaner 60. Thereby, the belt cleaner 60 removes transfer residual toner after the toner images including the last color (color toner images obtained by superimposing K on Y, M and C) are secondarily transferred.

On the other hand, when a single color image (for example, a monochrome image) is formed in the image forming apparatus 1, a toner image of one color is formed on the photoconductive drum 31, primarily transferred onto the intermediate transfer belt 41, and then, secondarily transferred onto the sheet S immediately.

In this case, the secondary transfer roll 70 is set at the position in contact with the intermediate transfer belt 41 in accordance with timing at which the toner image of one color is primarily transferred and transported to the secondary transfer portion T2. Meanwhile, the belt cleaner 60 is immediately set at the position in contact with the intermediate transfer belt 41, and removes transfer residual toner remaining after the toner image is secondarily transferred.

Meanwhile, in the sheet transportation system, the sheets S are picked up by the pick-up roll 72 from the sheet container 71, transported one-by-one by the transport rolls 73, and then transported to the position of the registration rolls 74. After that, the sheet S is supplied to the secondary transfer portion T2 so as to accord with timing at which the toner images on the intermediate transfer belt 41 reach the secondary transfer portion T2, and is sandwiched between the back-up roll 49 and the secondary transfer roll 70 through the intermediate transfer belt 41. On this occasion, in the secondary transfer portion T2, the action of the transfer electric field formed between the secondary transfer roll 70 and the back-up roll 49 by the secondary transfer bias applied to the back-up roll 49 causes the toner images held on the intermediate transfer belt 41 to be secondarily transferred (collectively transferred) onto the sheet S.

After that, the sheet S on which the toner images are transferred is transported to the fixing device 80 by the guide 76 and the sheet transport belt 77 to make the toner images fixed, and is then discharged to the discharged sheet container 90.

<Description of Output Timing Control of Image Data for Writing>

Next, a description will be given of control of timing at which the image data for writing is outputted from the image processor 21 to the optical scanning device 30.

Figure 3:
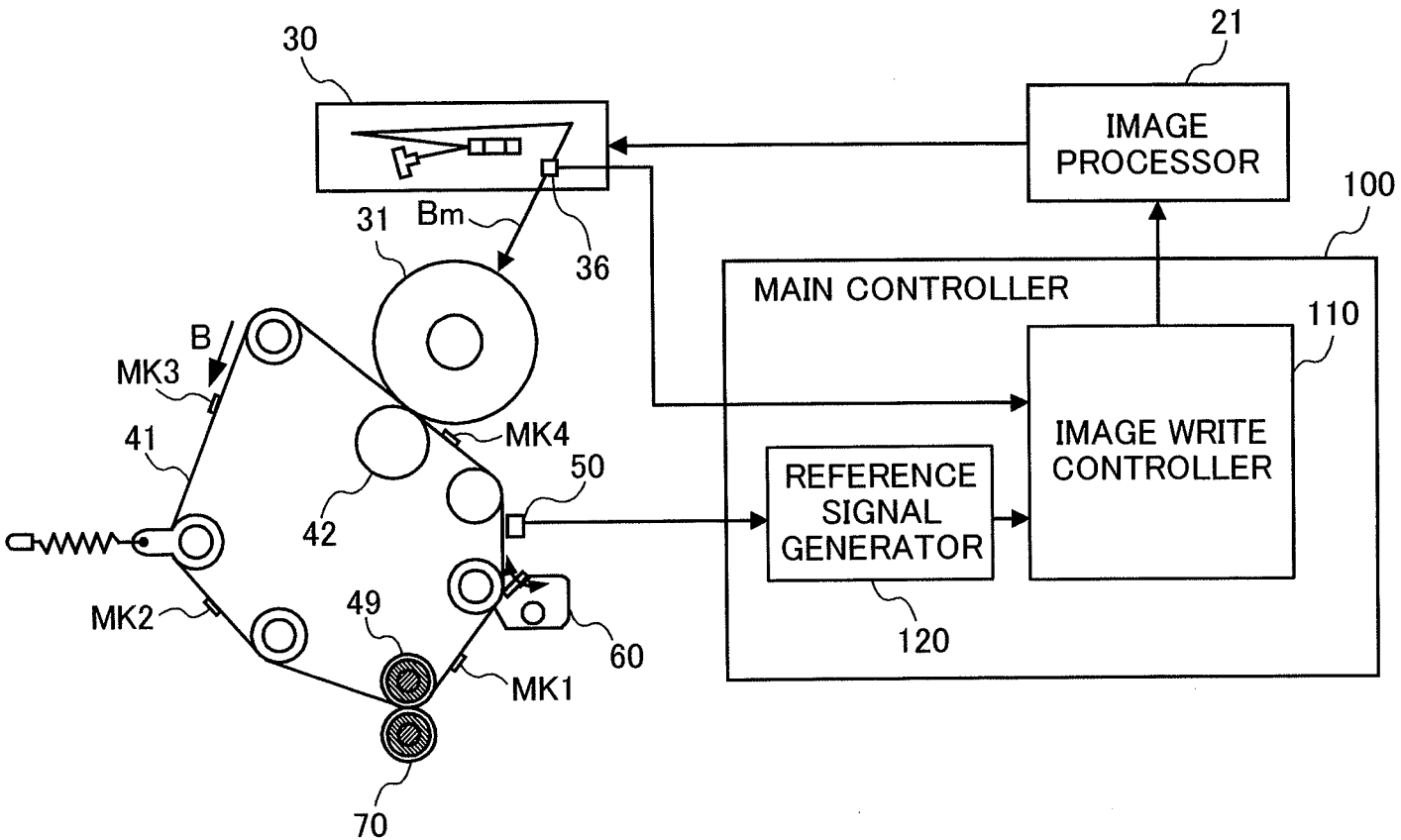
FIG. 3 is a diagram illustrating a configuration to control output timing of the image data for writing to the optical scanning device.

FIG. 3 is a diagram illustrating a configuration to control output timing of the image data for writing to the optical scanning device 30. As shown in FIG. 3, the main controller 100 generating various types of control signals for controlling operations of the units in the image forming apparatus 1 (see FIG. 1) is configured by a reference signal generator 120 and an image write controller 110. The reference signal generator 120 acquires the sticker detection signal about one of the stickers for position detection MK1 to MK4 outputted by the sticker detection unit 50, generates a "belt reference signal TRO" on the basis of the acquired sticker detection signal, and outputs the belt reference signal TRO to the image write controller 110. Meanwhile, the image write controller 110 controls the output timing of the image data for writing by using the belt reference signal TRO generated by the reference signal generator 120 and a signal (hereinafter, referred to as an "SOS signal") from an SOS (Start of Scan) sensor 36 provided in the optical scanning device 30.

As described above, the "belt reference signal TRO" is generated on the basis of the sticker detection signal about one of the stickers for position detection MK1 to MK4 outputted by the sticker detection unit 50, and is a signal serving as a reference for the output timing (the output start time point) of the image data for writing in the second scanning direction, when color toner images of Y, M, C and K are sequentially superimposed on the intermediate transfer belt 41.

Meanwhile, the "SOS signal" is a signal outputted when the SOS sensor 36 arranged on the optical path of the laser beam Bm in the optical scanning device 30 detects passing of the laser beam Bm before the laser beam Bm for each scan line scans the surface of the photoconductive drum 31, and is a signal serving as a reference for the output timing of the image data for writing for each scan line in the first scanning direction.

Figure 4:
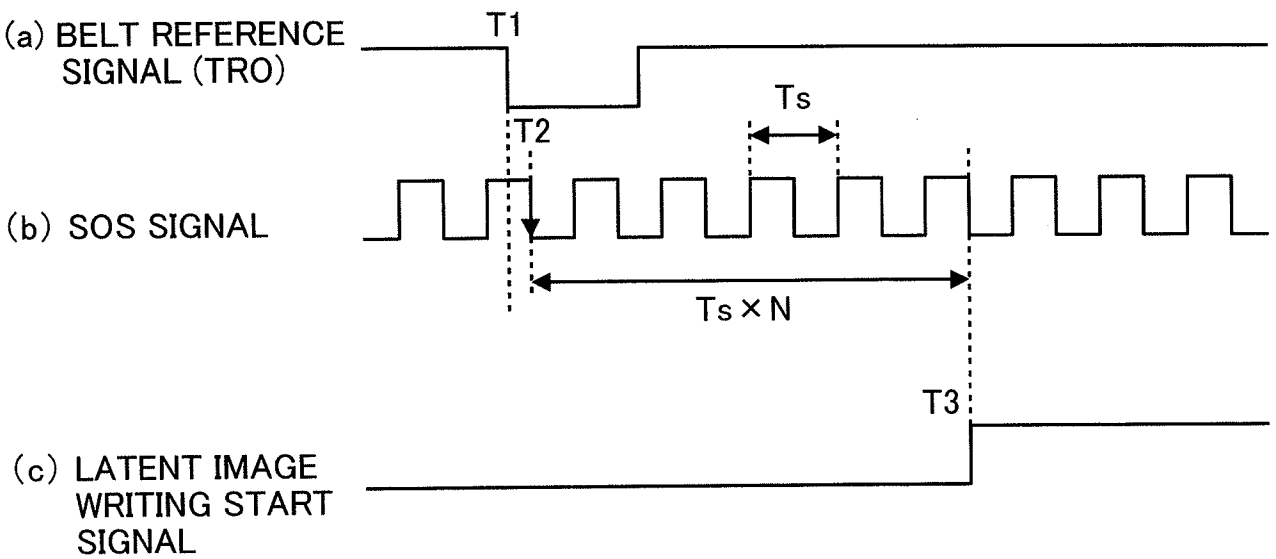
FIG. 4 is a diagram illustrating the output timing of the image data for writing controlled by the image write controller.

Next, FIG. 4 is a diagram illustrating the output timing of the image data for writing controlled by the image write controller 110. As shown in FIG. 4, when an electrostatic latent image is written onto the photoconductive drum 31, the image write controller 110 of the main controller 100 starts counting the number of falling (T2) of the SOS signal ((b) in FIG. 4) from a time point (T1) at which the belt reference signal TRO ((a) in FIG. 4) generated by the reference signal generator 120 falls. Then, the image write controller 110 raises a "latent image writing start signal" ((c) in FIG. 4) that is a signal to instruct a writing start in the second scanning direction (T3), at a time point (period of SOS signal Ts×N) when the counted value of the falling of the SOS signal reaches a predetermined value N (N: integer).

With this operation, the image write controller 110 causes the image processor 21 to output the image data for writing of Y, M, C or K to be a target for writing to the optical scanning device 30, after counting a predetermined number of pixel clocks from the rising of the latent image writing start signal.

<Description of Generation of Belt Reference Signal>

Next, a description will be given of generation of the belt reference signal TRO by the reference signal generator 120.

As described above, the reference signal generator 120 generates the belt reference signal TRO serving as a reference when the image data for writing is outputted from the image processor 21 to the optical scanning device 30, on the basis of the sticker detection signal about one of the stickers for position detection MK1 to MK4 outputted by the sticker detection unit 50.

Figure 5:
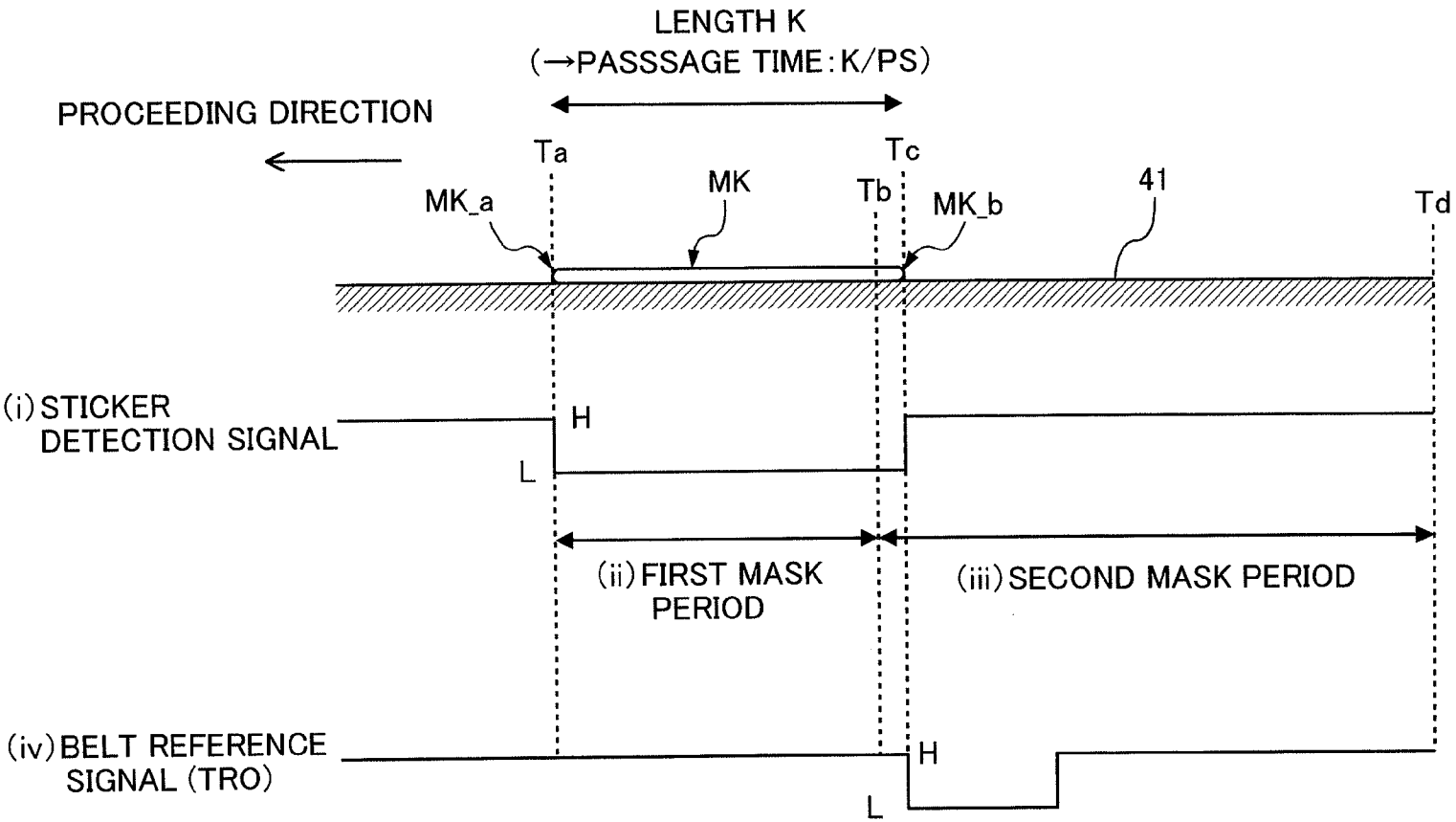
FIG. 5 is a diagram for illustrating usage of the sticker detection signal outputted from the sticker detection unit when the reference signal generator generates the belt reference signal.

Next, FIG. 5 is a diagram for illustrating usage of the sticker detection signal outputted from the sticker detection unit 50 when the reference signal generator 120 generates the belt reference signal TRO. As shown in FIG. 5, the reference signal generator 120 sets a first mask period ((ii) in FIG. 5) as an example of a first period, at a time point (Ta) when the sticker detection unit 50 detects a front end portion (MK_a) of one of the stickers for position detection MK1 to MK4 (hereinafter, referred to as the "sticker for position detection MK") and when the signal level of the sticker detection signal ((i) in FIG. 5) from the sticker detection unit 50 changes from a high level ("H") to a low level ("L") (makes a first change or is asserted).

This first mask period ((ii) in FIG. 5) is set to have a time length (a first time length) shorter than a time period that is required for the sticker for position detection MK, whose length in the proceeding direction of the intermediate transfer belt 41 is K, to pass the sticker detection unit 50. That is, the first mask period (Tb−Ta) is set to be shorter than K/PS where PS denotes a process speed (equal to a moving speed of the intermediate transfer belt 41) (Tb−Ta<K/PS). For this reason, a time point Tb at which the first mask period ends is earlier than a time point Tc at which a rear end portion (MK_b) of the sticker for position detection MK passes the sticker detection unit 50.

Then, in the first mask period, the reference signal generator 120 regards a change (change in the signal level between "H" and "L") of the sticker detection signal ((i) in FIG. 5) as invalid (ignores the change).

Subsequently, the reference signal generator 120 sets a second mask period ((iii) in FIG. 5) as an example of a second period having a second time length from the time point Tb at which the first mask period ends. In this second mask period ((iii) in FIG. 5), the reference signal generator 120 regards only a change in the signal level (a second change or a negation) from "L" to "H" detected for the first time after the start of the second mask period as valid, and regards the subsequent changes in the sticker detection signal ((i) in FIG. 5) as invalid (ignores the changes). Then, at the time point (Tc) when the signal level changes from "L" to "H" for the first time after the start of the second mask period, the reference signal generator 120 outputs the belt reference signal TRO ((iv) in FIG. 5: see FIG. 4) to the image write controller 110. That is, the reference signal generator 120 changes the signal level of the belt reference signal TRO to be outputted to the image write controller 110, from "H" to "L." As described above, the time point Tb at which the first mask period ((ii) in FIG. 5) ends is earlier than the time point Tc at which the rear end portion (MK_b) of the sticker for position detection MK passes the sticker detection unit 50. Thus, the change in the signal level from "L" to "H" detected for the first time after the start of the second mask period is caused by the rear end portion (MK_b) of the sticker for position detection MK.

The second time length set for the second mask period is set to be a time length shorter than a time period that is required from the start of the second mask period to an arrival of the front end portion (MK_a) of the next sticker for position detection MK to the arrangement position of the sticker detection unit 50. Thus, the first mask period is set due to the front end portion (MK_a) of the sticker for position detection MK.

As described above, the reference signal generator 120 of the main controller 100 detects the rear end portion (MK_b) of the sticker for position detection MK to generate the belt reference signal TRO, and outputs the belt reference signal TRO to the image write controller 110. Thus, as shown in FIG. 4 described above, the image write controller 110 causes the image processor 21 to output the image data for writing of Y, M, C or K to be a target for writing to the optical scanning device 30, with the belt reference signal TRO as a reference.

<Description of Configuration of Reference Signal Generator>

Figure 6:
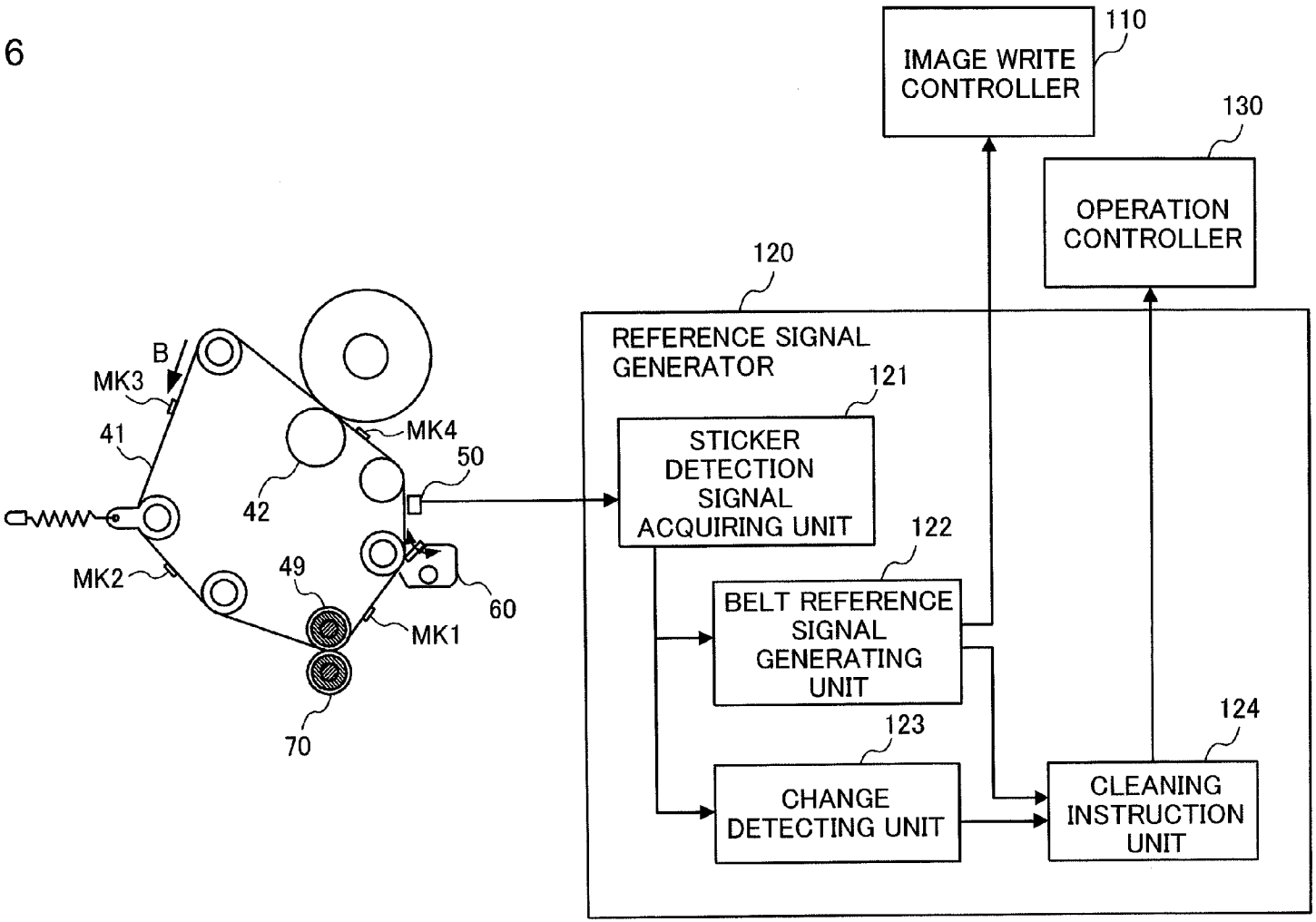
FIG. 6 is a diagram showing a configuration of the reference signal generator.

FIG. 6 is a diagram showing a configuration of the reference signal generator 120. As shown in FIG. 6, the reference signal generator 120 includes: a sticker detection signal acquiring unit 121 as an example of an acquiring unit that acquires the sticker detection signal ((i) in FIG. 5) from the sticker detection unit 50; and a belt reference signal generating unit 122 that sets the first mask period and the second mask period on the basis of the sticker detection signal acquired by the sticker detection signal acquiring unit 121, and that generates the belt reference signal ((iv) in FIG. 5) according to the sticker detection signal, the first mask period and the second mask period. The belt reference signal generating unit 122 generates the belt reference signal TRO according to the procedure shown in FIG. 5, and outputs the belt reference signal TRO to the image write controller 110.

In addition to the above-mentioned configuration, the reference signal generator 120 includes: a change detecting unit 123 and a cleaning instruction unit 124 that are as an example of a cleaning information outputting unit.

The change detecting unit 123 detects: a temporarily inactive state occurring in a period in which the belt reference signal generating unit 122 sets the first mask period; and a temporarily active state occurring in a period in which the belt reference signal generating unit 122 sets the second mask period. In the temporarily inactive state, the signal level of the sticker detection signal is changed from "L" to "H" (negated), and then changed from "H" to "L" (asserted) again. In the temporarily active state, the signal level of the sticker detection signal is changed from "H" to "L" (asserted), and then changed from "L" to "H" (negated) again. Additionally, the change detecting unit 123 generates one detection signal (hereinafter, referred to as a "change detection signal") every time the signal level is changed into the "temporarily inactive state" in the first mask period, and further generates one change detection signal every time the signal level is changed into the "temporarily active state" in the second mask period. The change detecting unit 123 outputs these change detection signals to the cleaning instruction unit 124.

The cleaning instruction unit 124 acquires the change detection signals from the change detecting unit 123, and measures the number of outputs of the change detection signals in either or both of the first mask period and the second mask period that are set by the belt reference signal generating unit 122. Additionally, the cleaning instruction unit 124 outputs information (information on cleaning of the transfer body) for giving an instruction to perform an operation to remove (clean) adhesion materials adhering to the intermediate transfer belt 41, in accordance with the measured number of outputs of the change detection signals.

That is, the cleaning instruction unit 124 determines whether or not the measured value about the number of outputs of the change detection signals acquired from the change detecting unit 123 is larger than a predetermined number in either or both of the first mask period and the second mask period. If the measured value about the number of outputs of the change detection signals is larger than the predetermined number, the cleaning instruction unit 124 outputs, to an operation controller 130 controlling operations of units in the image forming apparatus 1, an instruction signal that is information for giving an instruction to perform the operation to remove adhesion materials from the regions (see FIG. 2) where the stickers for position detection MK1 to MK4 are arranged on the intermediate transfer belt 41, or from the entire region of the intermediate transfer belt 41 including the transfer region Im (see FIG. 2).

On this occasion, the operation controller 130 included in the main controller 100 receives the information (information on cleaning of the transfer body) for giving an instruction to perform the operation to clean the intermediate transfer belt 41, from the cleaning instruction unit 124. Then, the operation controller 130 performs: display to prompt a user (operator), a maintenance worker (hereinafter, referred to as a "worker") or the like to clean the intermediate transfer belt 41 on a display panel (a display: not shown) provided for the image forming apparatus 1; a cleaning operation in which the intermediate transfer belt 41 is rotated in a state where the belt cleaner 60 is set at the position in contact with the intermediate transfer belt 41, by a function unit (not shown) performing cleaning of the intermediate transfer belt 41, after a series of image forming operations is finished; and the like, for example, as the operation to remove adhesion materials from the intermediate transfer belt 41. Alternatively, a notice for a prompt to clean the intermediate transfer belt 41 may be transmitted from the image forming apparatus 1 to a server (not shown) managed by a worker through a communication line (not shown). Furthermore, display to announce cleaning the intermediate transfer belt 41 in advance may be performed, in addition to the display for a prompt to clean the intermediate transfer belt 41.

<Description of Procedure of Generation Processing of Belt Reference Signal>

Figures 1, 7:
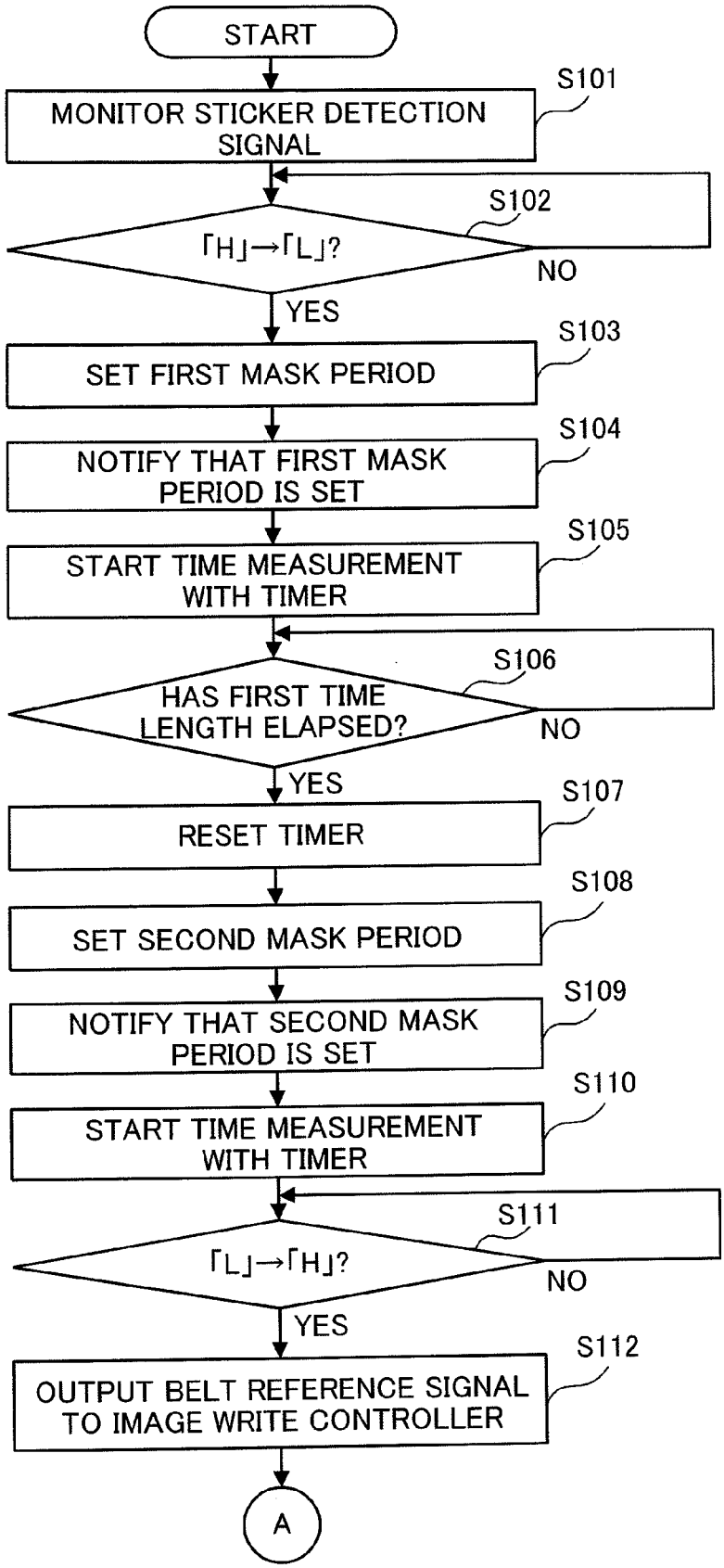
Figures 2, 7:
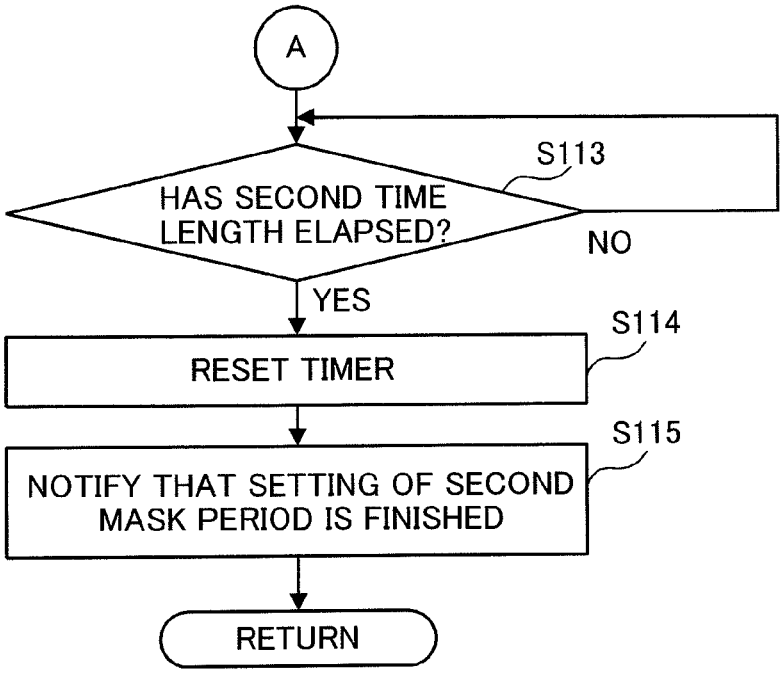

Next, FIGS. 7-1 and 7-2 are flowcharts showing a procedure of processing when the belt reference signal generating unit 122 of the reference signal generator 120 generates the belt reference signal TRO.

First, as shown in FIG. 7-1, the belt reference signal generating unit 122 monitors the sticker detection signal about the sticker for position detection MK acquired by the sticker detection signal acquiring unit 121, the sticker detection signal being outputted from the sticker detection unit 50 (Step 101). When the sticker detection signal changes from the high level ("H") to the low level ("L") (Yes in Step 102), the belt reference signal generating unit 122 sets the first mask period having the predetermined first time length (Step 103) and notifies the cleaning instruction unit 124 that the first mask period is set (Step 104). On the other hand, while the sticker detection signal maintains "H" (No in Step 102), the belt reference signal generating unit 122 does not set the first mask period.

On setting the first mask period, the reference signal generator 120 starts time measurement with a timer (Step 105) and monitors elapsing of the first time length (No in Step 106). The reference signal generator 120 ignores a change in the sticker detection signal (change in the signal level between "H" and "L") until the first time length of the first mask period elapses. Even if there is a change in the sticker detection signal, the reference signal generator 120 regards the change as invalid.

Then, when the first time length has elapsed (Yes in Step 106), the reference signal generator 120 resets the timer (Step 107). The reference signal generator 120 sets the second mask period having the predetermined second time length (Step 108), and notifies the cleaning instruction unit 124 that the second mask period is set (Step 109).

On setting the second mask period, the reference signal generator 120 starts time measurement with the timer (Step 110) and monitors a change in the signal level of the sticker detection signal from "L" to "H" (No in Step 111). When the signal level of the sticker detection signal changes from "L" to "H" (Yes in Step 111), the reference signal generator 120 outputs the belt reference signal TRO to the image write controller 110 (Step 112).

After that, as shown in FIG. 7-2, the reference signal generator 120 monitors elapsing of the second time length (No in Step 113). The reference signal generator 120 ignores a change in the sticker detection signal in the period before the second time length elapses. Even if there is a change in the sticker detection signal, the reference signal generator 120 regards the change as invalid. Then, when the second time length has elapsed (Yes in Step 113), the reference signal generator 120 resets the timer (Step 114) and notifies the cleaning instruction unit 124 that the setting of the second mask period is finished (Step 115). After that, the reference signal generator 120 starts the generation processing for the belt reference signal TRO in the next image forming cycle.

In the above processing, a description is given of setting in which the second mask period is started from the time point Tb (the time point when the first time length elapses in Step 106) at which the first mask period ends. However, not limited to such setting, the second mask period may start from any time point after the first mask period ends, as long as the time point is before the time point Tc at which the rear end portion (MK_b) of the sticker for position detection MK passes the sticker detection unit 50. That is, instead of the above-described setting in which the second mask period is started by using the end of the first mask period (the time point Tb) as a trigger, time measurement to start the second mask period may be started at the start of the first mask period, and the second mask period may be started by using, as a trigger, elapsing of a predetermined time period that is longer than the first time length forming the first mask period and shorter than a time period required for the rear end portion (MK_b) of the sticker for position detection MK to pass the sticker detection unit 50, for example. Furthermore, the second mask period may be started by using, as a trigger, elapsing of another predetermined time period after the first mask period ends.

<Description of Procedure of Output Processing of Instruction Signal for Removing Adhesion Materials>

Figures 1, 8:
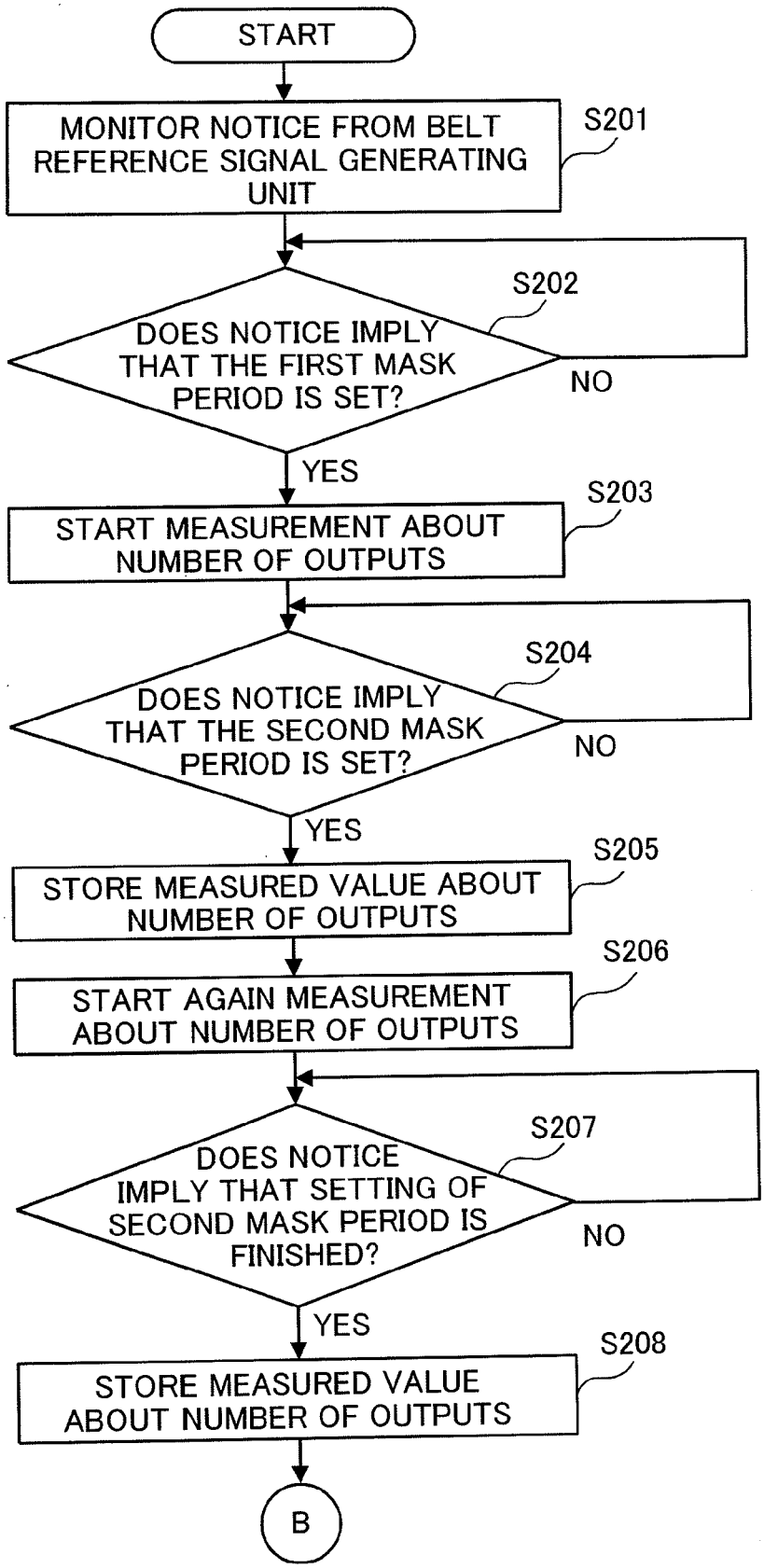
Figures 2, 8:
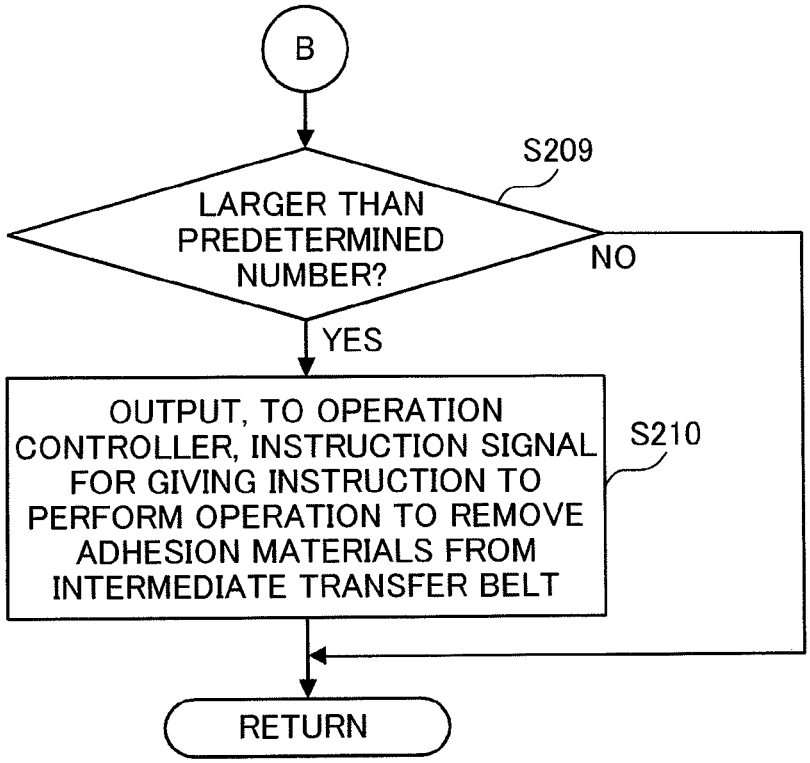

Next, FIGS. 8-1 and 8-2 are flowcharts showing a procedure of processing when the cleaning instruction unit 124 of the reference signal generator 120 outputs the instruction signal to give an instruction to perform the operation to remove adhesion materials from the intermediate transfer belt 41.

First, as shown in FIG. 8-1, the cleaning instruction unit 124 monitors a notice outputted from the belt reference signal generating unit 122 (Step 201). On acquiring from the belt reference signal generating unit 122 the notice (see Step 104 in FIG. 7-1) that the first mask period is set (Yes in Step 202), the cleaning instruction unit 124 starts measurement about the number of outputs of the change detection signals acquired from the change detecting unit 123 (Step 203). While not acquiring the notice that the first mask period is set (No in Step 202), the cleaning instruction unit 124 waits for the notice from the belt reference signal generating unit 122.

On acquiring from the belt reference signal generating unit 122 the notice (see Step 109 in FIG. 7-1) that the second mask period is set (Yes in Step 204), the cleaning instruction unit 124 stores the measured value about the number of outputs of the change detection signals acquired from the change detecting unit 123 in a memory (for example, a NVM 204 in FIG. 10 to be described later) (Step 205), and starts again the measurement about the number of outputs of the change detection signals acquired from the change detecting unit 123 (Step 206). While not acquiring the notice that the second mask period is set (No in Step 204), the cleaning instruction unit 124 continues the measurement about the number of outputs of the change detection signals and waits for the notice from the belt reference signal generating unit 122.

After that, on acquiring the notice (see Step 115 in FIG. 7-2) that the setting of the second mask period is finished (Yes in Step 207), the cleaning instruction unit 124 stores the measured value about the number of outputs of the change detection signals acquired from the change detecting unit 123 in the memory (the NVM 204) (Step 208). While not acquiring the notice that the setting of the second mask period is finished (No in Step 207), the cleaning instruction unit 124 continues the measurement about the number of outputs of the change detection signals and waits for the notice from the belt reference signal generating unit 122.

Then, as shown in FIG. 8-2 next, after acquiring the notice that the setting of the second mask period is finished, the cleaning instruction unit 124 determines whether or not any one of the measured value in the first mask period and the measured value in the second mask period stored in the memory is larger than the predetermined number (Step 209). If this measured value is larger than the predetermined number (Yes in Step 209), the cleaning instruction unit 124 outputs, to the operation controller 130 controlling operations of units in the image forming apparatus 1, the instruction signal for giving an instruction to perform the operation to remove adhesion materials from the intermediate transfer belt 41 (Step 210). If this measured value is smaller than the predetermined number (No in Step 209), the processing is finished.

The cleaning instruction unit 124 may set the same value or different values for each of the measured value in the first mask period and the measured value in the second mask period, as the "predetermined number" described above.

For example, the region of the sticker for position detection MK may have a different surface state (a friction coefficient and the like), as compared with the other regions (the region on which the surface of the intermediate transfer belt 41 directly appears). In this case, the degree of easiness in adhesion of adhesion materials is different between the region of the sticker for position detection MK and the other regions. Thus, the degree of adhesion of adhesion materials is objectively estimated by setting the "predetermined number" to different values for each of the measured value in the first mask period and the measured value in the second mask period, in consideration of the degree of easiness in adhesion of adhesion materials (the surface state). Furthermore, since the areas are also different between the region of the sticker for position detection MK and the other regions, an estimate of the degree of adhesion of adhesion materials is made by taking into account the difference in areas.

Additionally, the cleaning instruction unit 124 may be configured so as to output, to the operation controller 130, the instruction signal to give an instruction to perform the operation to remove adhesion materials from the intermediate transfer belt 41, if both of the measured value in the first mask period and the measured value in the second mask period are larger than the predetermined number. This is because the degree of adhesion of adhesion materials in the entire surface of the intermediate transfer belt 41 including the region of the sticker for position detection MK is estimated.

Furthermore, the cleaning instruction unit 124 may be configured so as to output, to the operation controller 130, the instruction signal to give an instruction to perform the operation to remove adhesion materials from the intermediate transfer belt 41, if only the measured value in the first mask period is larger than the predetermined number. This is because the degree of adhesion of adhesion materials in the region of the sticker for position detection MK is estimated.

Additionally, the cleaning instruction unit 124 may be configured so as to output, to the operation controller 130, the instruction signal to give an instruction to perform the operation to remove adhesion materials from the intermediate transfer belt 41, if only the measured value in the second mask period is larger than the predetermined number. This is because the degree of possibility of adhesion of adhesion materials also in the region of the sticker for position detection MK is estimated as prediction of future developments.

<Description of Action caused by Instruction to Perform Operation for Removing Adhesion Materials>

Subsequently, a description will be given of action caused by the cleaning instruction unit 124 giving an instruction to perform the operation to remove adhesion materials from the intermediate transfer belt 41, when the number of outputs of the change detection signals is larger than the predetermined number in either or both of the first mask period and the second mask period.

Figure 9:
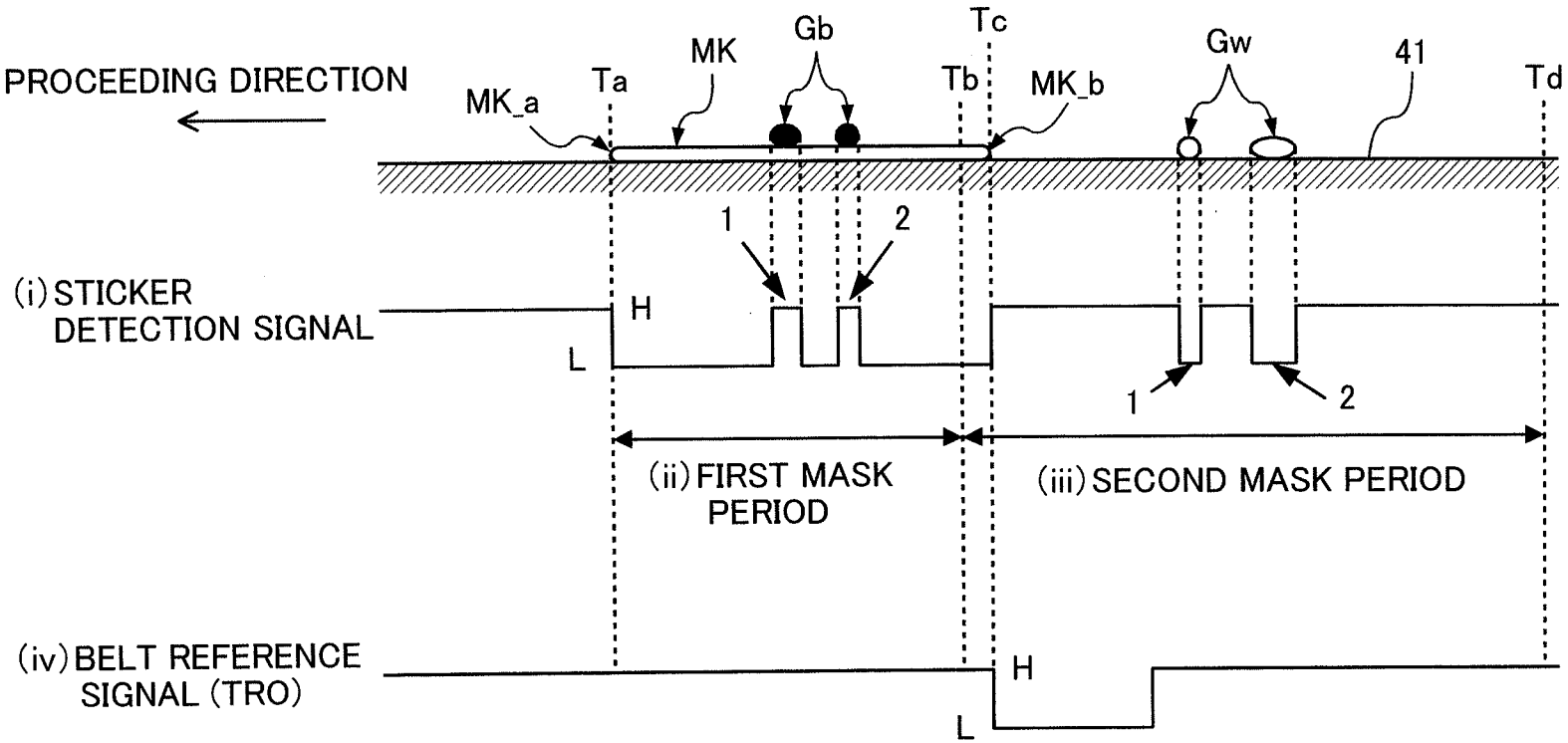
FIG. 9 is a diagram for illustrating usage of the sticker detection signal in a state where adhesion materials, such as dirt or toner, having lower reflectivity than the sticker for position detection adhere to the sticker for position detection, and adhesion materials, such as dirt or toner, having higher reflectivity than the surface of the intermediate transfer belt adhere to the region on the intermediate transfer belt other than the sticker for position detection.

Next, FIG. 9 is a diagram for illustrating usage of the sticker detection signal in a state where adhesion materials Gb, such as dirt or toner, having lower reflectivity than the sticker for position detection MK adhere to the sticker for position detection MK, and adhesion materials Gw, such as dirt or toner, having higher reflectivity than the surface of the intermediate transfer belt 41 adhere to the region on the intermediate transfer belt 41 other than the sticker for position detection MK. In the state shown in FIG. 9, corresponding to the adhesion materials Gb on the sticker for position detection MK, the signal level of the sticker detection signal ((i) in FIG. 9) is changed from "L" to "H" (negated), and is then changed from "H" to "L" (asserted). Additionally, corresponding to the adhesion materials Gw on the intermediate transfer belt 41, the signal level of the sticker detection signal is changed from "H" to "L" (asserted), and is then changed from "L" to "H" (negated).

As described above, in the generation processing about the belt reference signal TRO performed by the belt reference signal generating unit 122 of the reference signal generator 120 according to the present exemplary embodiment, a change in the sticker detection signal in the first mask period is regarded as invalid. Additionally, in the second mask period, only a change from "L" to "H" detected for the first time after the start of the second mask period is regarded as valid, and the subsequent changes in the sticker detection signal are regarded as invalid. Thus, even if either or both of the adhesion materials Gb on the sticker for position detection MK and the adhesion materials Gw on the intermediate transfer belt 41 exist, detecting the front end portion (MK_a) of the sticker for position detection MK sets the first mask period, and sets the subsequent second mask period, without being affected by these adhesion materials. Accordingly, the rear end portion (MK_b) of the sticker for position detection MK is detected, and the belt reference signal TRO ((iv) in FIG. 9) is generated on the basis of the rear end portion (MK_b) of the sticker for position detection MK.

A state in which the adhesion materials Gb on the sticker for position detection MK and the adhesion materials Gw on the region other than the sticker for position detection MK are detected much, for example, implies strong possibility that the adhesion materials Gb and Gw exist also in the front end portion (MK_a) and the rear end portion (MK_b) of the sticker for position detection MK and a periphery region thereof. Especially, if a step is formed between the sticker for position detection MK and the surface of the intermediate transfer belt 41, the adhesion materials Gb and Gw tend to pile up in the front end portion (MK_a) and the rear end portion (MK_b) of the sticker for position detection MK and the periphery region thereof. For this reason, in the case where the adhesion materials Gb and Gw are detected much, it may be assumed that there is strong possibility that the adhesion materials Gb and Gw exist in the front end portion (MK_a) and the rear end portion (MK_b) of the sticker for position detection MK and the periphery region thereof.

Piling of the adhesion materials Gb and Gw in the front end portion (MK_a) of the sticker for position detection MK leads to variations in the start time point of setting of the first mask period, which results in a case where the first negation in the second mask period is not detected. Meanwhile, piling of the adhesion materials Gb and Gw in the rear end portion (MK_b) of the sticker for position detection MK leads to variations in the time point at which the first negation in the second mask period is detected, which may result in variations in the time point at which the belt reference signal TRO ((iv) in FIG. 9) is generated on the basis of the rear end portion (MK_b) of the sticker for position detection MK. Thereby, the output timing of the image data for writing in the second scanning direction is shifted for each color, which may lead to color misregistration in a color image.

Accordingly, the reference signal generator 120 according to the present exemplary embodiment detects a change in the sticker detection signal outputted from the sticker detection unit 50 in either or both of the first mask period and the second mask period, and determines whether or not the number of detected changes (the measured value of the number of outputs of the change detection signals) is larger than the predetermined number in either or both of the first mask period and the second mask period. If the measured value of the number of outputs of the change detection signals is larger than the predetermined number, the reference signal generator 120 judges that there is strong possibility that the adhesion materials Gb and Gw exist in the front end portion (MK_a) and the rear end portion (MK_b) of the sticker for position detection MK and the periphery region thereof. Thus, the reference signal generator 120 instructs the operation controller 130 to perform the operation to remove adhesion materials from the intermediate transfer belt 41. Thereby, the adhesion materials Gb and Gw are removed from the front end portion (MK_a) and the rear end portion (MK_b) of the sticker for position detection MK and the periphery region thereof, and detection accuracy for the front end portion (MK_a) and the rear end portion (MK_b) of the sticker for position detection MK by the sticker detection unit 50 is improved. As a result, variations in the time point at which the belt reference signal TRO ((iv) in FIG. 9) is generated are reduced, and thus the output timing of the image data for writing in the second scanning direction for each color accords with each other, which may prevent color misregistration in a color image.

For example, consider a case where the predetermined number in the first mask period is set to one and the predetermined number in the second mask period is set to two. In the state shown in FIG. 9 described above, the measured value of the number of outputs of the change detection signals in the second mask period is one, and thus the measured value of the number of outputs of the change detection signals does not exceed the predetermined number in the second mask period. However, since the measured value of the number of outputs of the change detection signals in the first mask period is two, the measured value of the number of outputs of the change detection signals is larger than the predetermined number in the first mask period. Accordingly, in this case, the instruction to perform the operation to remove adhesion materials from the intermediate transfer belt 41 is given to the operation controller 130.

Note that the condition with which the instruction to perform the operation to remove adhesion materials from the intermediate transfer belt 41 is given to the operation controller 130 may be set in various ways, as described above. For example, in the state shown in FIG. 9 described above, the measured value of the number of outputs of the change detection signals in the second mask period does not exceed the predetermined number, and thus the instruction to perform the operation to remove adhesion materials from the intermediate transfer belt 41 may not be given to the operation controller 130.

<Description of Internal Configuration of Reference Signal Generator>

Figure 10:
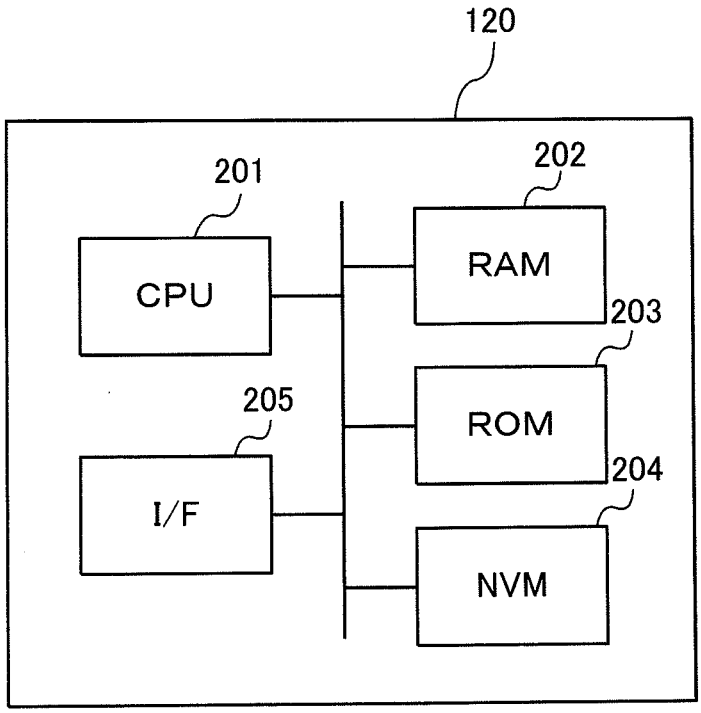
FIG. 10 is a block diagram showing an internal configuration of the reference signal generator.

Next, FIG. 10 is a block diagram showing an internal configuration of the reference signal generator 120. As shown in FIG. 10, the reference signal generator 120 includes a CPU 201, a RAM 202, a ROM 203, the non-volatile memory (NVM) 204 and an interface (I/F) 205. The CPU 201 executes digital calculation processing in accordance with a predetermined processing program, for executing the generation processing of the belt reference signal TRO, the output processing of the instruction signal to remove adhesion materials, and the like, described above. The RAM 202 is used as a working memory or the like for the CPU 201. The ROM 203 stores therein various setting values (for example, data on the first time length and the second time length and data on the predetermined numbers about the first mask period and the second mask period) used in the processing in the CPU 201. The NVM 204, such as a flash memory, is a rewritable, holds data even in a case where the power supply is stopped, and is backed up by a battery. The I/F 205 controls input and output of signals with each of the units, such as the sticker detection unit 50, the image write controller 110, an external memory (not shown) and the like. The NVM 204 functions also as the memory storing the measured values about the number of outputs of the change detection signals in the first mask period and the second mask period.

The CPU 201 reads the processing program from the external memory and loads it into a main memory (the RAM 202), and executes the generation processing of the belt reference signal TRO.

Note that, as another provision method on this processing program, the program may be provided while being prestored in the ROM 203, and be loaded into the RAM 202. In addition, when an apparatus is provided with a rewritable ROM 203 such as an EEPROM, only this program may be installed in the ROM 203 after the CPU 201 is set, and then may be loaded into the RAM 202. Moreover, this program may also be transmitted to the reference signal generator 120 through a network such as the Internet, and then installed in the ROM 203 of the reference signal generator 120, and further loaded into the RAM 202. In addition, the program may be loaded into the RAM 202 from an external recording medium such as a DVD-ROM, a flash memory or the like.

<Description of Circuit Configuration of Sticker Detection Unit>

Next, a configuration of the sticker detection unit 50 will be described.

Figure 11A:
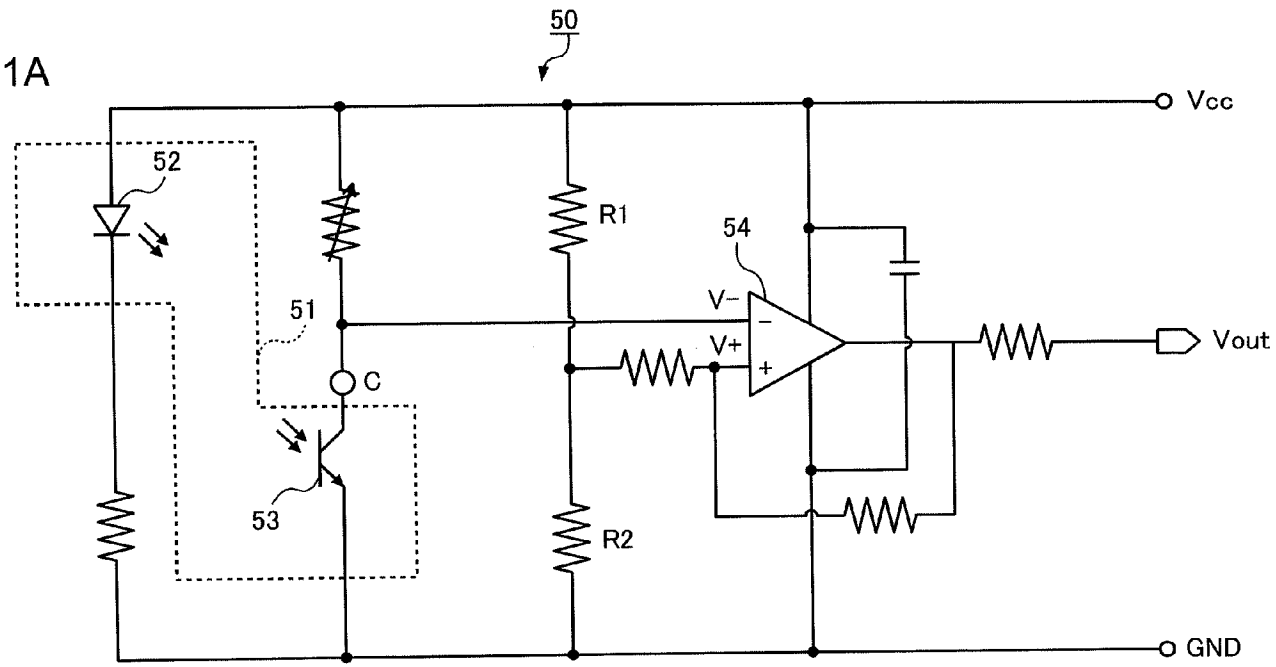
FIGS. 11A and 11B are circuit diagrams showing the configuration of the sticker detection unit outputting the sticker detection signal.
Figure 11B:
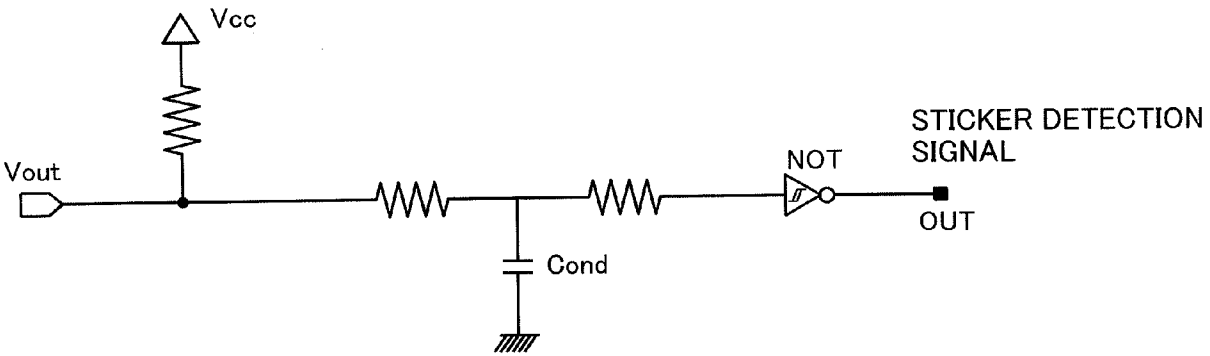

FIGS. 11A and 11B are circuit diagrams showing the configuration of the sticker detection unit 50 outputting the sticker detection signal. In a precedent stage circuit shown in FIG. 11A, as a sensor unit 51 arranged so as to face the sticker for position detection MK on the intermediate transfer belt 41, the sticker detection unit 50 includes: a light-emitting diode (LED) 52 that is lighted up by a power supply voltage Vcc and emits light toward the sticker for position detection MK on the intermediate transfer belt 41; and a light sensor 53 that is connected by employing an open collector type and receives the light having been emitted from the LED 52 and reflected by the sticker for position detection MK. The light sensor 53 has an output terminal (C) pulled up by the power supply voltage Vcc, and the output terminal (C) is connected to a V− side, which is one input terminal of a comparator 54. Additionally, a comparison voltage for comparison with the output voltage from the light sensor 53 is inputted to a V+ side, which is the other input terminal of the comparator 54. This comparison voltage is set to be smaller than the power supply voltage Vcc by dividing the power supply voltage Vcc with resistances R1 and R2.

The light sensor 53 of the sensor unit 51 is turned on by detecting the reflected light from the sticker for position detection MK, and the output terminal (C) thereof is set at a ground potential GND. Meanwhile, the light sensor 53 of the sensor unit 51 is turned off in a state where the reflected light from the sticker for position detection MK is not incident thereon, and the output terminal (C) thereof is set at the power supply voltage Vcc. With this configuration, an output terminal Vout of the comparator 54 outputs an output signal having a signal level "L" when the reflected light from the sticker for position detection MK is not incident on the light sensor 53, and outputs an output signal having a signal level "H" when the light sensor 53 detects the reflected light from the sticker for position detection MK.

Then, the output terminal Vout of the comparator 54 is connected with a subsequent stage circuit shown in FIG. 11B, and outputs an output signal having the signal level "L" or "H" to the subsequent stage circuit in accordance with the output voltage from the light sensor 53.

In the subsequent stage circuit shown in FIG. 11B, in order to remove chattering generated in the output signal from the output terminal Vout of the precedent stage circuit shown in FIG. 11A, the output signal from the output terminal Vout is inputted to a Schmitt trigger (NOT) through a CR filter including a grounded capacitor Cond, and is then outputted from an output terminal OUT as the sticker detection signal.

With this configuration, the sticker detection signal outputted from the output terminal OUT in the signal output circuit according to the present exemplary embodiment is generated so as to be a signal having a short variation range in the signal level from "H" to "L" and "L" to "H" at the front end portion (MK_a) and the rear end portion (MK_b) of the sticker for position detection MK, respectively, as shown in (i) in FIG. 5 described above.

Note that the part of the circuit other than the sensor unit 51 shown in FIGS. 11A and 11B may be configured integrally with the sensor unit 51, or separately from the sensor unit 51. If configured separately, the configuration may be such that only the sensor unit 51 is arranged at the position facing the stickers for position detection MK1 to MK4 on the intermediate transfer belt 41, and the part of the circuit other than the sensor unit 51 is arranged in a region different from that of the sensor unit 51.

To the region of the sticker for position detection MK and the region on the intermediate transfer belt 41 other than the sticker for position detection MK, not only the adhesion materials Gb and Gw existing independently of each other adhere, as shown in FIG. 9 described above. For example, in addition to these adhesion materials, uniform stain may also adhere to the surface of the sticker for position detection MK. In such a case, in the sticker detection unit 50 having the circuit configuration shown in FIGS. 11A and 11B described above, the output voltage from the output terminal (C) at the time of detection of the sticker for position detection MK does not sufficiently decrease to the ground potential GND, and thus the signal level outputted from the output terminal Vout of the comparator 54 may repeat changes between "H" and "L." Then, in the subsequent stage circuit of FIG. 11B, the signal outputted from the output terminal Vout of the comparator 54 has a waveform dulled by the CR filter, and thus the sticker detection signal outputted from the output terminal OUT of the Schmitt trigger (NOT) has a short duration period of an active state (hereinafter, referred to as an "active period") caused by the sticker for position detection MK. That is, the sticker detection signal outputted from the sticker detection unit 50 has a characteristic that the active period becomes short in accordance with the degree of the uniform stain on the surface of the sticker for position detection MK.

If the degree of such uniform stain on the surface of the sticker for position detection MK exceeds an allowable level, the active period of the sticker detection signal becomes too short, which leads to the possibility that the time point at which the rear end portion (MK_b) of the sticker for position detection MK is detected is before the start time point of the second mask period.

Accordingly, in order to monitor uniform stain on the surface of the sticker for position detection MK, the reference signal generator 120 according to the present exemplary embodiment may detect the active state of the sticker detection signal outputted from the sticker detection unit 50, and determine whether or not the time interval of the end time point of the detected active state and the end time point of the first mask period (equal to the start time point of the second mask period) is longer than a predetermined time period.

That is, how short the active period of the sticker detection signal becomes is measured by comparison with the first time length in the first mask period set from the start time point of the active state. If this time interval is longer than the predetermined time period (that is, in a case where the length of the active period (change duration time) is shorter than a predetermined value), the degree of the uniform stain on the surface of the sticker for position detection MK may exceed the allowable level, which leads to the possibility that the time point at which the rear end portion (MK_b) of the sticker for position detection MK is detected is before the start time point of the second mask period. Thus, it is judged that the detection accuracy for the rear end portion (MK_b) of the sticker for position detection MK will decrease. Accordingly, the instruction to perform the operation to remove adhesion materials or stain from the intermediate transfer belt 41 is given to the operation controller 130.

As described above, instead of measuring the number of changes in the sticker detection signal, measuring the length of the active period of the sticker detection signal may also improve accuracy of detection of the front end portion (MK_a) and the rear end portion (MK_b) of the sticker for position detection MK performed by the sticker detection unit 50. Additionally, adhesion materials and stain on the sticker for position detection MK and the periphery region thereof may be monitored by using both of the number of changes in the sticker detection signal and the length of the active period of the sticker detection signal.

<Description of Action by Generation Processing of Belt Reference Signal in Reference Signal Generator>

Next, a description will be given of action caused by the belt reference signal generating unit 122 of the reference signal generator 120 according to the present exemplary embodiment performing the generation processing about the belt reference signal TRO described above.

Figure 12:
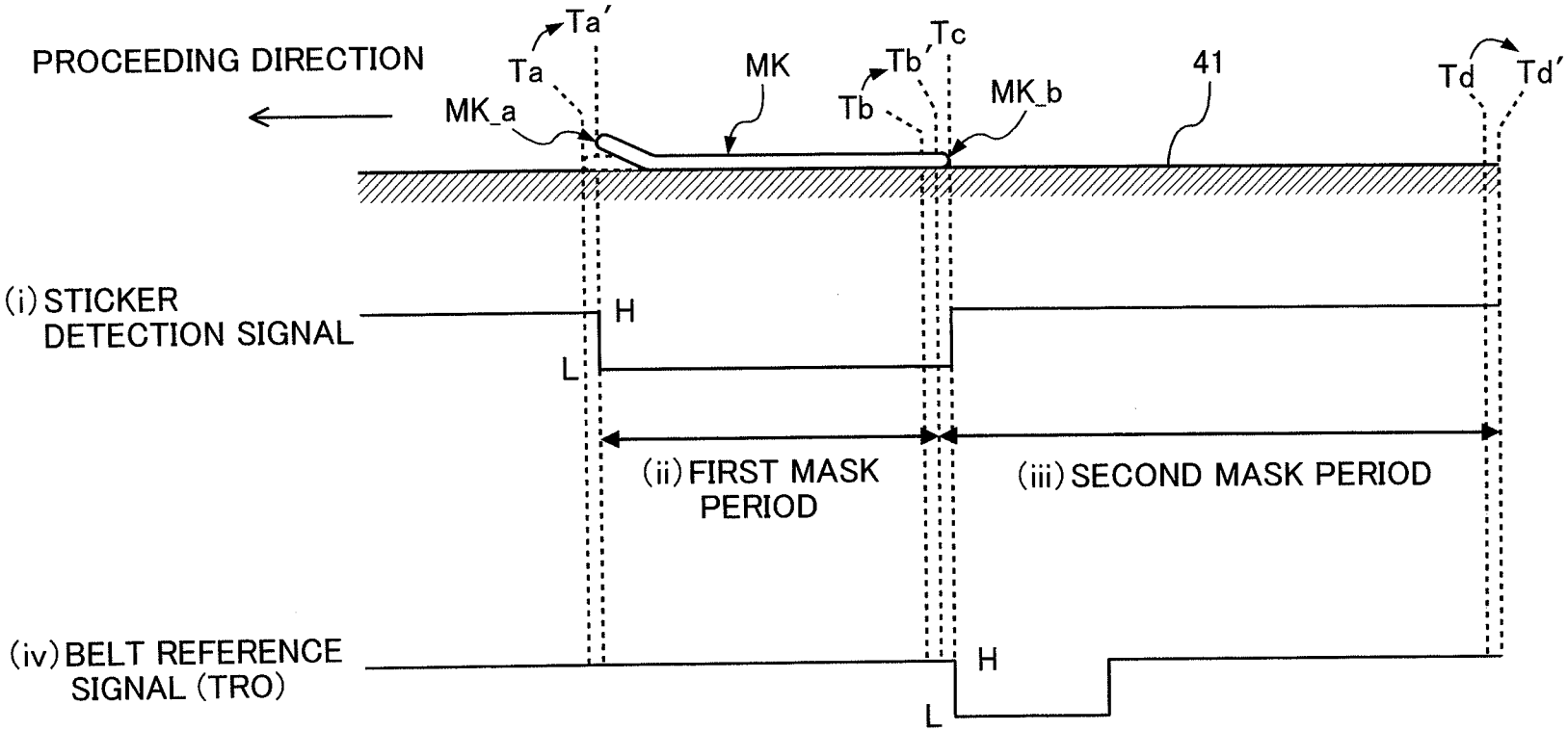
FIG. 12 is a diagram showing a first specific example of the action caused by the generation processing of the belt reference signal in the belt reference signal generating unit.

FIG. 12 is a diagram showing a first specific example of the action caused by the generation processing of the belt reference signal TRO in the reference signal generator 120 (the belt reference signal generating unit 122).

FIG. 12 shows a case where the belt cleaner 60 (see FIG. 1) removing the transfer residual toner on the intermediate transfer belt 41 after the toner images are secondarily transferred comes into contact with the sticker for position detection MK, and thereby the front end portion (MK_a) of the sticker for position detection MK is peeled off. In the state shown in FIG. 12, due to peeling of the front end portion (MK_a) of the sticker for position detection MK, the front end portion (MK_a) is positioned farther on the downstream side in the proceeding direction of the intermediate transfer belt 41 than in a normal state (a broken line: see also FIG. 5). Thereby, a time point (Ta') at which the sticker detection signal ((i) in FIG. 12) is asserted from the high level ("H") to the low level ("L") is delayed as compared with the time point (Ta) at which the change from "H" to "L" occurs in the normal state. In addition, since the front end portion (MK_a) of the sticker for position detection MK is not fixed due to peeling, the time point (Ta') at which the signal is asserted from "H" to "L" is not stable. Thus, on the occasion of generating the belt reference signal TRO with the front end portion (MK_a) of the sticker for position detection MK as a reference, the output timing of the image data for writing in the second scanning direction is shifted for each color, which may lead to color misregistration in a color image.

In contrast, in the generation processing about the belt reference signal TRO performed by the reference signal generator 120 according to the present exemplary embodiment, the amount of peeling supposed to occur at the front end portion (MK_a) of the sticker for position detection MK is obtained in advance by an experiment or the like, and the first time length of the first mask period (Tb'−Ta'(=Tb−Ta)) is set on the basis of the supposed amount of peeling. Specifically, the first time length shortened by the supposed amount of peeling is set as the first mask period.

For this reason, even when the front end portion (MK_a) of the sticker for position detection MK is peeled off, the time point Tb' at which the first mask period ends is set to a time point earlier than the time point Tc at which the rear end portion (MK_b) of the sticker for position detection MK passes the sticker detection unit 50. Thus, the second mask period in which the belt reference signal TRO ((iv) in FIG. 12) is generated at the time point (Tc) when the sticker detection signal is negated from "L" to "H" for the first time is started from a time point earlier than the time point Tc at which the rear end portion (MK_b) of the sticker for position detection MK passes the sticker detection unit 50. Accordingly, the rear end portion (MK_b) of the sticker for position detection MK is surely detected. In addition, it is unlikely that the rear end portion (MK_b) of the sticker for position detection MK is peeled off due to contact with the belt cleaner 60, and thus the position of the rear end portion (MK_b) of the sticker for position detection MK is hardly changed.

Accordingly, the reference signal generator 120 according to the present exemplary embodiment stably generates the belt reference signal TRO ((iv) in FIG. 12) on the basis of the rear end portion (MK_b) of the sticker for position detection MK whose position is hardly changed even when coming into contact with the belt cleaner 60. For this reason, even when the front end portion (MK_a) of the sticker for position detection MK is peeled off, the shift in the output timing of the image data for writing in the second scanning direction for each color is reduced.

Figure 13A:
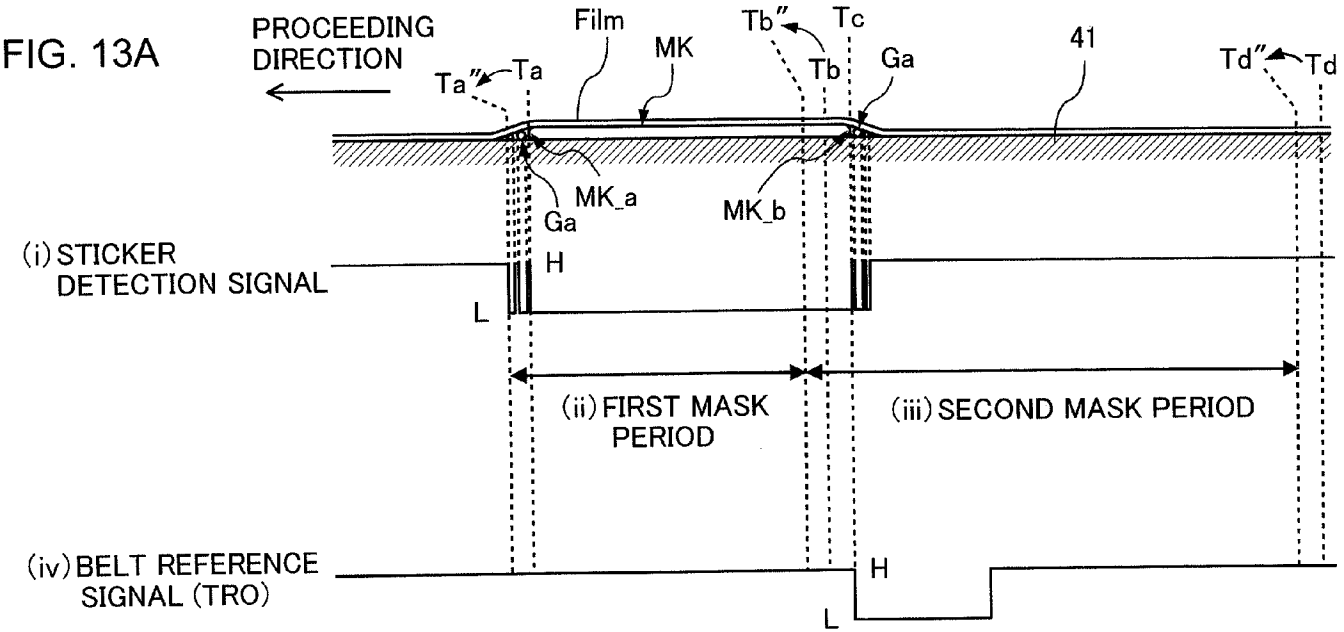
FIGS. 13A and 13B are diagrams showing a second specific example of the action caused by the generation processing of the belt reference signal in the belt reference signal generating unit.
Figure 13B:
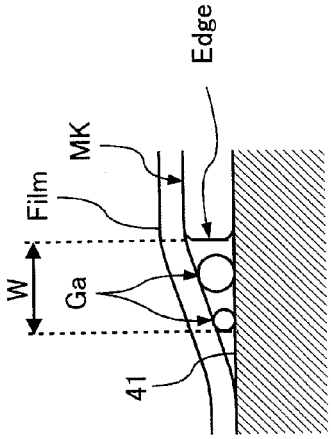

FIGS. 13A and 13B are diagrams showing a second specific example of the action caused by the generation processing of the belt reference signal TRO in the reference signal generator 120 (the belt reference signal generating unit 122).

FIG. 13A shows a case where the arrangement region of the sticker for position detection MK and a periphery region thereof, or a region that is positioned outside of the transfer region Im (see FIG. 2) including the arrangement region of the sticker for position detection MK and that extends the whole circumference in the circumferential direction (the proceeding direction) of the intermediate transfer belt 41 are covered with a thin film (a covering film: Film). Such a configuration prevents peeling of the front end portion (MK_a) of the sticker for position detection MK due to contact with the belt cleaner 60 (see FIG. 1) shown in FIG. 12 described above.

The stickers for position detection MK may have any one of the following configurations: each of the stickers for position detection MK is covered with a film (Film) for individual covering; and all of the stickers for position detection MK are integrally covered with one film (Film).

However, with the configuration shown in FIG. 13A, around an edge portion (Edge) of the sticker for position detection MK, air bubbles Ga may be formed between the film (Film) and the surface of the intermediate transfer belt 41, as shown in FIG. 13B. In such a case, the signal level of the sticker detection signal ((i) in FIG. 13A) changes due to the air bubbles Ga formed around the front end portion (MK_a) and the rear end portion (MK_b) of the sticker for position detection MK. That is, as shown in FIG. 13A, on the upstream side of the front end portion (MK_a) of the sticker for position detection MK, the sticker detection signal ((i) in FIG. 13A) is asserted from the high level ("H") to the low level ("L") due to the air bubbles Ga. Thereby, a time point (Ta") at which the sticker detection signal is asserted from "H" to "L" becomes earlier than the time point (Ta) at which the signal is asserted from "H" to "L" because of the actual front end portion (MK_a) of the sticker for position detection MK.

In contrast, in the generation processing about the belt reference signal TRO performed by the reference signal generator 120 according to the present exemplary embodiment, the size of a region (W in FIG. 13B: hereinafter, referred to as a "bubble forming region") in which the air bubbles Ga are formed and that is supposed to be generated around the edge portion (Edge) of the sticker for position detection MK is obtained in advance by an experiment or the like, and the first time length of the first mask period (Tb'−Ta'(=Tb−Ta)) is set on the basis of the size of the supposed bubble forming region W. Specifically, the first time length lengthened by the size of the supposed bubble forming region W is set as the first mask period. Thereby, the time point Tb' at which the first mask period ends is set to a time point earlier than the time point Tc at which the rear end portion (MK_b) of the sticker for position detection MK passes the sticker detection unit 50, and the time point Tb' is set so that the time interval between the time points Tb' and Tc are short.

For this reason, even when the bubble forming region W is generated on the front end portion (MK_a) side of the sticker for position detection MK and when the air bubbles Ga cause the sticker detection signal to be asserted from "H" to "L" on the upstream side as compared with the actual front end portion (MK_a), the time point Tb' at which the first mask period ends is set to a time point earlier than the time point Tc at which the rear end portion (MK_b) of the actual sticker for position detection MK passes the sticker detection unit 50. Thus, the second mask period in which the belt reference signal TRO ((iv) in FIG. 13A) is generated at the time point (Tc) when the sticker detection signal is negated from "L" to "H" for the first time is started from a time point earlier than the time point Tc at which the rear end portion (MK_b) of the sticker for position detection MK passes the sticker detection unit 50. Additionally, on the rear end portion (MK_b) side of the sticker for position detection MK, the rear end portion (MK_b) is positioned on the upstream side of the bubble forming region W. Thus, the change in the sticker detection signal from "L" to "H" for the first time after the start of the second mask period is caused by the rear end portion (MK_b). Accordingly, the rear end portion (MK_b) of the sticker for position detection MK is surely detected.

In addition, the time interval between the time point Tb' at which the first mask period ends and the time point Tc at which the rear end portion (MK_b) of the sticker for position detection MK passes the sticker detection unit 50 are set to be short. Thus, the belt reference signal TRO ((iv) in FIG. 13A) is stably generated on the basis of the rear end portion (MK_b) of the sticker for position detection MK, while reducing influence of adhesion materials, such as dirt or toner, existing on the intermediate transfer belt 41 passing between these time points.

As described above, in the reference signal generator 120 according to the present exemplary embodiment, even when the sticker for position detection MK is configured so as to be covered with the film (Film), the shift in the output timing of the image data for writing in the second scanning direction for each color is reduced.

As has been described above, in the image forming apparatus 1 according to the present exemplary embodiment, the reference signal generator 120 sets the first mask period at the time point when the sticker detection unit 50 detects the front end portion (MK_a) of one of the stickers for position detection MK1 to MK4, and when the sticker detection signal is changed (asserted) from the high level ("H") to the low level ("L"). In this first mask period, a change in the sticker detection signal is ignored. Even if there is a change in the sticker detection signal, this change is regarded as invalid. Subsequently, the second mask period is set from the time point Tb at which the first mask period ends, or from a time point after the time point Tb. In this second mask period, only a change (a negation) in the signal level from "L" to "H" detected for the first time after the start of the second mask period is regarded as valid, and the subsequent changes in the sticker detection signal are ignored. Even if there is a change in the sticker detection signal, this change is regarded as invalid. Then, the reference signal generator 120 outputs the belt reference signal TRO to the image write controller 110 at the time point (Tc) when the signal level changes from "L" to "H" for the first time after the start of the second mask period.

Thereby, even when the front end portion (MK_a) of the sticker for position detection MK is peeled off, and when the sticker for position detection MK is configured so as to be covered with the film (Film), the shift in the output timing of the image data for writing in the second scanning direction for each color is reduced, and thereby, accuracy for positioning color toner images is improved.

Furthermore, the image forming apparatus 1 according to the present exemplary embodiment detects the number of changes in the sticker detection signal outputted from the sticker detection unit 50 and the length of the active period of the sticker detection signal in either or both of the first mask period and the second mask period, and determines whether or not the detected number of changes is larger than a predetermined value (the predetermined number) in either or both of the first mask period and the second mask period, or whether or not the length of the active period (change duration time) is shorter than a predetermined value (the predetermined time period). If the detected number of changes is larger than the predetermined value (the predetermined number) or if the length of the active period is shorter than the predetermined value (the predetermined time period), it is judged that there is strong possibility that adhesion materials and stain exist in the front end portion (MK_a) and the rear end portion (MK_b) of the sticker for position detection MK and the periphery region thereof. Thus, the instruction to perform the operation to remove adhesion materials from the intermediate transfer belt 41 is given to the operation controller 130. Thereby, the adhesion materials and stain are removed from the front end portion (MK_a) and the rear end portion (MK_b) of the sticker for position detection MK and the periphery region thereof, and accuracy of detection of the front end portion (MK_a) and the rear end portion (MK_b) of the sticker for position detection MK performed by the sticker detection unit 50 is improved. As a result, variations in the time point at which the belt reference signal TRO is generated is reduced, and thus the output timing of the image data for writing in the second scanning direction for each color accords with each other, which may prevent color misregistration in a color image.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

a latent image forming unit that emits light in accordance with image data on receiving input of the image data, and that scans and exposes an image carrier with the light, to form a latent image on the image carrier;

a transfer body on which a toner image is transferred and a reference index is formed, the toner image being formed by developing the latent image on the image carrier, the reference index serving as a reference for setting an output start time point from which the image data is outputted to the latent image forming unit;

a detecting unit that is arranged so as to face the reference index formed on the transfer body, and that outputs a detection signal changing in accordance with passing of an adhesion material on the transfer body including the reference index;

a controller that acquires the detection signal outputted from the detecting unit, starts a first period during which a change of the detection signal is ignored, according to a first change occurring in the detection signal, starts a second period after the first period elapses, regards a second change of the detection signal occurring for the first time in the second period as the reference of the output start time point of the image data to the latent image forming unit, and ignores a change of the detection signal after the second change occurs in the second period, thereby to control output of the image data; and a cleaning information outputting unit that acquires the detection signal outputted from the detecting unit, measures any one of change duration time of the detection signal caused by passing of the reference index and the number of changes of the detection signal in at least any one of the first period and the second period set by the controller, and outputs information on cleaning of the transfer body in accordance with any one of the change duration time and the number of changes having been measured.

2. The image forming apparatus according to claim 1, wherein the cleaning information outputting unit outputs the information on cleaning of the transfer body, if any one of conditions that the change duration time caused by the passing of the reference index in the first period is shorter than a predetermined time period and that the number of changes in at least any one of the first period and the second period is larger than a predetermined number is satisfied.

3. The image forming apparatus according to claim 2, wherein the cleaning information outputting unit gives an instruction to clean the transfer body if the number of changes in the first period is larger than a predetermined first number, and outputs the information on cleaning of the transfer body if the number of changes in the second period is larger than a predetermined second number that is different from the predetermined first number.

4. The image forming apparatus according to claim 2, wherein the cleaning information outputting unit outputs any one of information to instruct a display unit to perform display to prompt a worker to clean the transfer body, and information to instruct a function unit performing the cleaning of the transfer body to perform a cleaning operation, as the information on cleaning of the transfer body.

5. A control device comprising:

an acquiring unit acquiring a detection signal from a detecting unit that is arranged so as to face a reference index formed on a transfer body on which a toner image held on an image carrier is transferred, the detecting unit outputting the detection signal changing in accordance with passing of an adhesion material on the transfer body including the reference index;

a controller that starts a first period during which a change of the detection signal is ignored, according to a first change occurring in the detection signal having been acquired, starts a second period after the first period elapses, regards a second change of the detection signal occurring for the first time in the second period as a reference of an output start time point of image data to a latent image forming unit, and ignores a change of the detection signal after the second change occurs in the second period, thereby to control output of the image data, the latent image forming unit scanning and exposing the image carrier with light emitted in accordance with the image data, to form a latent image being a source of the toner image on the image carrier; and a cleaning information outputting unit that measures any one of change duration time of the detection signal caused by passing of the reference index and the number of changes of the detection signal in at least any one of the first period and the second period set by the controller, and outputs information on cleaning of the transfer body in accordance with any one of the change duration time and the number of changes having been measured.

6. The control device according to claim 5, wherein the cleaning information outputting unit outputs the information on cleaning of the transfer body, if any one of conditions that the change duration time caused by the passing of the reference index in the first period is shorter than a predetermined time period and that the number of changes in at least any one of the first period and the second period is larger than a predetermined number is satisfied.

7. The control device according to claim 6, wherein the cleaning information outputting unit gives an instruction to clean the transfer body if the number of changes in the first period is larger than a predetermined first number, and outputs the information on cleaning of the transfer body if the number of changes in the second period is larger than a predetermined second number that is different from the predetermined first number.

8. A detecting method of a reference index on a transfer body comprising:

acquiring a detection signal from a detecting unit that is arranged so as to face a reference index formed on a transfer body on which a toner image held on an image carrier is transferred, the detecting unit outputting the detection signal changing in accordance with passing of an adhesion material on the transfer body including the reference index;

starting a first period having a first time length during which a change of the detection signal is ignored, according to a first change of the detection signal thus acquired;

starting a second period having a second time length after the first period elapses;

setting an output start time point of image data to a latent image forming unit with a second change of the detection signal occurring for the first time in the second period regarded as a reference, the latent image forming unit scanning and exposing the image carrier with light emitted in accordance with the image data, to form a latent image being a source of the toner image on the image carrier;

ignoring a change of the detection signal after the second change occurs in the second period;

measuring any one of change duration time of the detection signal caused by passing of the reference index and the number of changes of the detection signal in at least any one of the first period and the second period; and outputting information on cleaning of the transfer body in accordance with any one of the change duration time and the number of changes having been measured.

9. A non-transitory computer readable medium storing a program that causes a computer to execute a process for detecting a reference index on a transfer body, the process comprising:

acquiring a detection signal from a detecting unit that is arranged so as to face a reference index formed on a transfer body on which a toner image held on an image carrier is transferred, the detecting unit outputting the detection signal changing in accordance with passing of an adhesion material on the transfer body including the reference index;

starting a first period having a first time length during which a change of the detection signal is ignored, according to a first change of the detection signal thus acquired;

starting a second period having a second time length after the first period elapses;

setting an output start time point of image data to a latent image forming unit with a second change of the detection signal occurring for the first time in the second period regarded as a reference, the latent image forming unit scanning and exposing the image carrier with light emitted in accordance with the image data, to form a latent image being a source of the toner image on the image carrier;

ignoring a change of the detection signal after the second change occurs in the second period;

measuring any one of change duration time of the detection signal caused by passing of the reference index and the number of changes of the detection signal in at least any one of the first period and the second period; and outputting information on cleaning of the transfer body in accordance with any one of the change duration time and the number of changes having been measured.

* * * * *